US008408931B2

(12) United States Patent
Sato et al.

(10) Patent No.: US 8,408,931 B2
(45) Date of Patent: Apr. 2, 2013

(54) ELECTRICAL CONNECTOR

(75) Inventors: Yuzo Sato, Tokyo (JP); Hiroaki Obikane, Tokyo (JP); Yasufumi Yahiro, Tokyo (JP); Akira Kimura, Aomori (JP); Takayuki Nishimura, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 301 days.

(21) Appl. No.: 12/963,931

(22) Filed: Dec. 9, 2010

(65) Prior Publication Data

US 2011/0263140 A1 Oct. 27, 2011

(30) Foreign Application Priority Data

Apr. 27, 2010 (JP) ..... 2010-101993
Jul. 14, 2010 (JP) ..... 2010-159667

(51) Int. Cl.
*H01R 13/627* (2006.01)
*H01R 12/00* (2006.01)

(52) U.S. Cl. ..... 439/357; 439/74

(58) Field of Classification Search ..... 439/353, 439/357, 74
See application file for complete search history.

(56) References Cited

U.S. PATENT DOCUMENTS

| | | | | |
|---|---|---|---|---|
| 4,335,929 | A | 6/1982 | Abernethy | |
| 5,120,256 | A * | 6/1992 | Walden | 439/553 |
| 5,154,620 | A * | 10/1992 | Martucci et al. | 439/73 |
| 5,199,884 | A * | 4/1993 | Kaufman et al. | 439/74 |
| 5,224,866 | A * | 7/1993 | Nakamura et al. | 439/81 |
| 5,281,161 | A * | 1/1994 | Kanai | 439/357 |
| 5,346,405 | A | 9/1994 | Mosser, III et al. | |
| 5,545,051 | A * | 8/1996 | Summers et al. | 439/350 |
| 5,626,482 | A * | 5/1997 | Chan et al. | 439/74 |
| 5,803,752 | A * | 9/1998 | McHugh | 439/74 |
| 5,836,773 | A * | 11/1998 | McHugh et al. | 439/74 |
| 5,885,093 | A * | 3/1999 | Champion et al. | 439/101 |
| 5,931,689 | A * | 8/1999 | Patel | 439/346 |
| 5,975,916 | A * | 11/1999 | Okura | 439/74 |
| 6,296,524 | B1 * | 10/2001 | Goto | 439/660 |
| 6,645,005 | B2 * | 11/2003 | Wu | 439/563 |
| 6,805,571 | B2 * | 10/2004 | Huang | 439/330 |
| 6,875,027 | B2 * | 4/2005 | Ye et al. | 439/74 |
| 7,112,091 | B2 * | 9/2006 | Okura et al. | |
| 7,128,581 | B2 * | 10/2006 | Igarashi et al. | 439/74 |
| 7,318,754 | B1 | 1/2008 | Vaden et al. | |
| 7,588,443 | B2 * | 9/2009 | Wu et al. | 439/74 |
| 7,658,636 | B2 * | 2/2010 | Takeuchi et al. | 439/357 |
| 7,674,115 | B2 * | 3/2010 | Midorikawa | 439/74 |
| 7,828,559 | B2 * | 11/2010 | Chen et al. | 439/74 |
| 7,845,958 | B2 * | 12/2010 | Hoshino et al. | 439/74 |
| 7,901,218 | B2 * | 3/2011 | Sato et al. | 439/74 |
| 8,052,457 | B2 * | 11/2011 | Miyazaki et al. | 439/357 |
| 8,092,232 | B2 * | 1/2012 | Takeuchi | 439/74 |
| 8,292,634 | B2 * | 10/2012 | Takahashi | 439/71 |
| 8,292,635 | B2 * | 10/2012 | Little et al. | 439/74 |
| 2005/0059302 | A1 | 3/2005 | Sablatzky | |
| 2006/0178029 | A1 | 8/2006 | Fabian | |

FOREIGN PATENT DOCUMENTS

| | | | |
|---|---|---|---|
| JP | 2007-095371 | A | 4/2007 |
| JP | 2009-283357 | A | 12/2009 |

* cited by examiner

*Primary Examiner* — Neil Abrams
(74) *Attorney, Agent, or Firm* — Foley & Lardner LLP

(57) ABSTRACT

Provided is a technique of reducing a force required to couple a receptacle connector and a plug connector. A receptacle assistant fitting of the receptacle connector includes a cantilevered lock beam having a deflection part extending in a direction substantially parallel to a connector mounting surface of a receptacle side substrate and in the outside of a receptacle housing. A plug assistant fitting of the plug connector includes an engagement part that pushes aside the free end of the lock beam and rides over the free end of the lock beam so as to be engaged with the free end of the lock beam when the plug connector and the receptacle connector are coupled to each other.

13 Claims, 34 Drawing Sheets

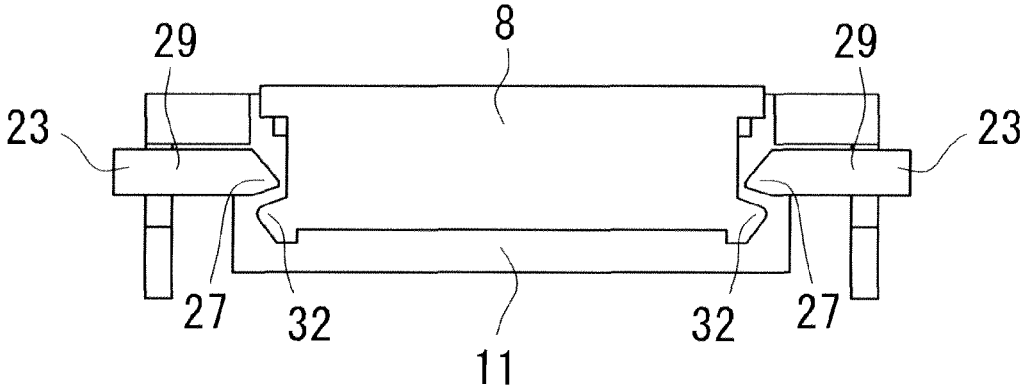
Fig. 15
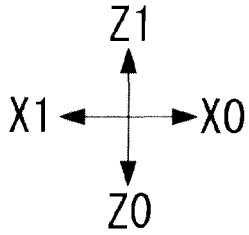

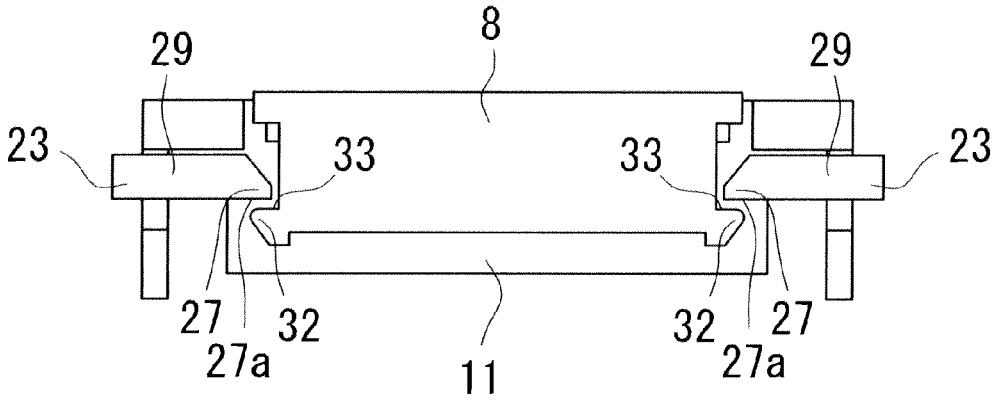
Fig. 16
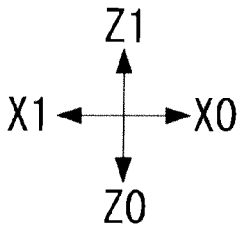

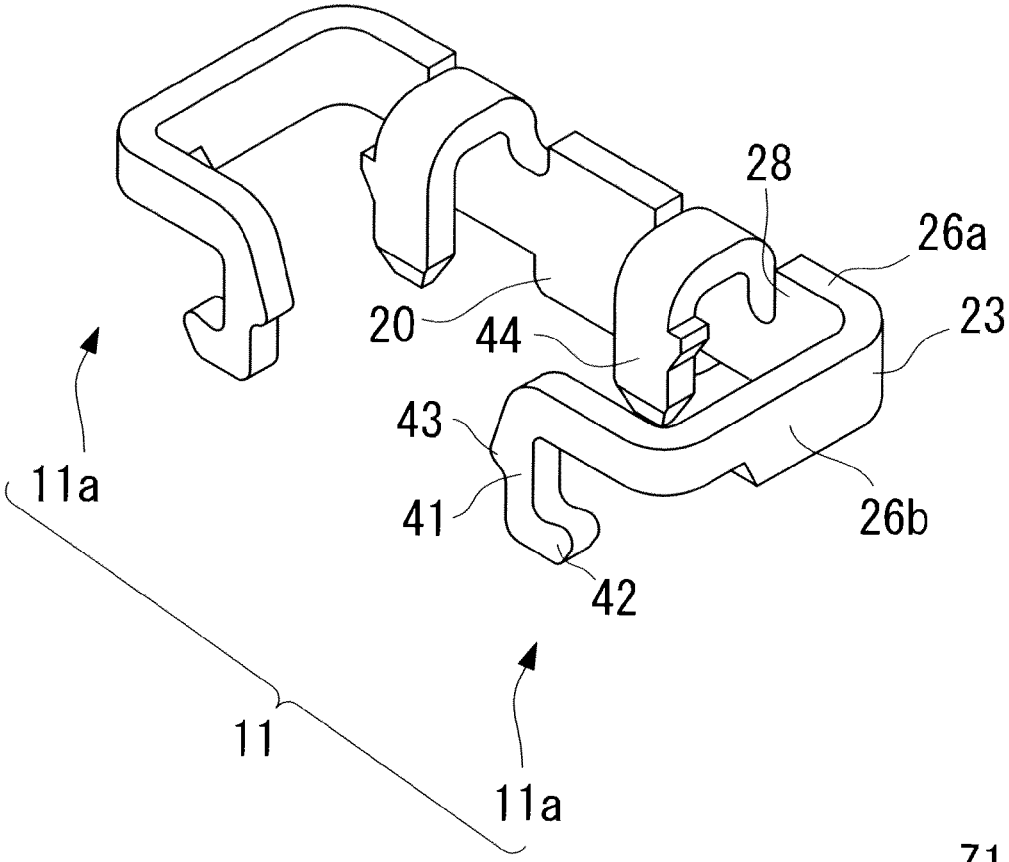
Fig. 24
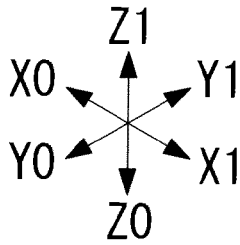

Prior Art

ELECTRICAL CONNECTOR

INCORPORATION BY REFERENCE

This application is based upon and claims the benefit of priority from Japanese patent application No. 2010-101993, filed on Apr. 27, 2010, and Japanese patent application No. 2010-159667, filed on Jul. 14, 2010, the disclosure of which is incorporated herein in its entirety by reference.

BACKGROUND OF THE INVENTION

1. Field of the Invention

The present invention relates to an electrical connector.

2. Description of Related Art

Such a technique includes patent document 1 (Japanese Patent Application Publication No. 2007-95371) that discloses an electrical connector used to electrically connect substrates and formed by fitting a receptacle connector 50 and a plug connector 51 as shown in FIG. 32 of the present application. A lock part 52 is formed in the receptacle connector 50, and the lock part 52 has a convex part 53 on a top end thereof. On the other hand, a plug side hold-down 54 is provided on an edge of a side face of the plug connector 51, and a lock hole 55 is provided in the plug side hold-down 54. In this structure, the convex part 53 at the edge of the lock part 52 formed in the receptacle connector 50 is elastically deformed and locked to the lock hole 55 provided in the plug connector 51, so that the plug connector 51 is locked to the receptacle connector 50.

Further, patent document 2 (Japanese Unexamined Patent Application Publication No. 2009-283357) discloses Board to Board connector structure composed of a plug connector 60 mounted on a circuit substrate and a receptacle connector 61 mounted on another circuit substrate, as shown in FIG. 33 of the present application. The plug connector 60 includes a plug housing 62 formed of insulating synthetic resin, conductive plug contacts 63 fixed to the plug housing 62, and plug reinforcement fittings 64 to reinforce a fitting force of the connector. The receptacle connector 61 that fits to the plug connector 60 includes a receptacle housing 65 formed of insulating synthetic resin, receptacle contacts 66 fixed to the receptacle housing 65 and electrically and mechanically connects to the plug contacts 63, and receptacle reinforcement fittings 67 to reinforce the fitting force of the connector in engagement with the plug reinforcement fittings 64.

As shown in FIG. 34 of the present application, the plug reinforcement fitting 64 includes a piece-like engagement part 68 which is engaged with a corresponding position of the receptacle reinforcement fitting 67. The engagement part 68 includes an engagement piece 68*a*, and a convex part 68*b* protruding outwardly at a leading end of the engagement piece 68*a*. On the other hand, the receptacle reinforcement fitting 67 includes a fixed part 69 fixed to the receptacle housing 65, and a piece-like engagement part 70 folded back from the end of the fixed part 69 by 180 degrees and extending vertically. The engagement part 70 includes a plate-like engagement piece 70*a*, and a groove-like recessed part 70*b* formed at the center of the engagement piece 70*a* formed by crushing in a direction of the plate thickness. The protruding convex part 68*b* provided in the engagement part 68 of the plug reinforcement fitting 64 is engaged with the recessed part 70*b* formed by the crushing, so as to reinforce the fitting force of the plug connector 60 and the receptacle connector 61.

SUMMARY OF THE INVENTION

The present inventors have found a problem that coupling the receptacle connector and the plug connector disclosed in the patent documents 1 and 2 still need to be improved.

One of the objects of the present invention is to provide a technique for reducing a force that is required to couple a first connector part (for example, plug connector) and a second connector part (for example, receptacle connector).

In one aspect of the present invention, an electrical connector includes: a first connector part having a first housing and a first contact supported by the first housing, the first connector part being mounted on a first substrate; and a second connector part having a second housing that is capable of accommodating the first housing and a second contact supported by the second housing, the second connector part being mounted on a second substrate. The first contact and the second contact are contacted with each other by coupling the first connector part and the second connector part so as to accommodate the first housing in the second housing. The first connector part and the second connector part are provided with a first assistant fitting and a second assistant fitting, respectively, to ensure coupling strength of the first connector part and the second connector part. The second assistant fitting of the second connector part includes a cantilevered lock beam having a deflection part extending in a direction substantially parallel to a connector mounting surface of the second substrate and in the outside of the second housing. The first assistant fitting of the first connector part includes an engagement part that pushes aside the free end of the lock beam and rides over the free end of the lock beam so as to be engaged with the free end of the lock beam when the first connector part is coupled to the second connector part.

Preferably, in the electrical connector, the deflection part of the lock beam extends along with an outer peripheral surface of the second housing, and the free end of the lock beam projects inside the second housing.

Preferably, in the electrical connector, the free end of the lock beam has an inclined surface formed therein that allows the engagement part of the first assistant fitting to easily push aside the free end of the lock beam.

Preferably, the electrical connector further includes a displacement regulating part that regulates displacement of the free end of the lock beam in a direction in which the first housing is removed from the second housing.

Preferably, in the electrical connector, the displacement regulating part is formed as a part of the second housing.

Preferably, in the electrical connector, the displacement regulating part is formed as a part of the second assistant fitting.

Preferably, in the electrical connector, the second assistant fitting further includes a substrate ground part that regulates the displacement of the displacement regulating part itself by fixing the substrate ground part to the connector mounting surface of the second substrate.

Preferably, in the electrical connector, the substrate ground part of the second assistant fitting is formed near the displacement regulating part.

Preferably, in the electrical connector, the lock beam is supported by the substrate ground part. The second assistant fitting further includes: a lock beam support part that is connected to the substrate ground part, and extends along the lock beam from the substrate ground part toward the fixed end of the lock beam; and a lock beam coupling part that couples the lock beam support part to the fixed end of the lock beam.

Preferably, the electrical connector includes an unlocking mechanism that withdraws the free end of the lock beam projecting inside the second housing in a direction opposite to the projecting direction.

Preferably, in the electrical connector, the unlocking mechanism includes a torque generation means that generates torque for the lock beam to withdraw the free end of the lock beam projecting inside the second housing in the direction opposite to the projection direction.

Preferably, in the electrical connector, the torque generation means includes a cantilevered torque generation beam that connects to a longitudinal direction middle part of the lock beam and extends in a direction substantially parallel to the connector mounting surface of the second substrate.

Preferably, in the electrical connector, the free end of the torque generation beam is formed outside the second housing.

Since the second assistant fitting includes the cantilevered lock beam having the deflection part extending in a direction substantially parallel to the connector mounting surface of the second substrate in the outside of the second housing, the following advantageous effects can be obtained in comparison to the lock part disclosed in the patent document 1. That is, the lock beam can be easily deflected since sufficient beam length can be secured. If the lock beam is easily deflected, the engagement part of the first assistant fitting can easily push aside the free end of the lock beam. Accordingly, in the configuration stated above, the force required when the first connector part and the second connector part are coupled can be reduced.

The above and other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

FIG. 15 is a front view showing a state in which a plug assistant fitting and a receptacle assistant fitting according to a fourth exemplary embodiment are engaged with each other;

FIG. 16 is a front view showing a state in which a plug assistant fitting and a receptacle assistant fitting according to a fifth exemplary embodiment are engaged with each other;

FIG. 24 is a perspective view of a receptacle assistant fitting seen from a coupling side;

1 CONNECTOR (ELECTRICAL CONNECTOR)

2 PLUG SIDE SUBSTRATE (FIRST SUBSTRATE)

2*a* CONNECTOR MOUNTING SURFACE

3 RECEPTACLE SIDE SUBSTRATE (SECOND SUBSTRATE)

3*a* CONNECTOR MOUNTING SURFACE
4 PLUG CONNECTOR (FIRST CONNECTOR PART)
5 RECEPTACLE CONNECTOR (SECOND CONNECTOR PART)
6 PLUG HOUSING (FIRST HOUSING)
7 PLUG CONTACT (FIRST CONTACT)
8 PLUG ASSISTANT FITTING (FIRST ASSISTANT FITTING)
9 RECEPTACLE HOUSING (SECOND HOUSING)
10 RECEPTACLE CONTACT (SECOND CONTACT)
11 RECEPTACLE ASSISTANT FITTING (SECOND ASSISTANT FITTING)
13 REAR SURFACE
14 SIDE SURFACE
20 SUBSTRATE GROUND PART
21 LOCK BEAM SUPPORT PART
22 LOCK BEAM COUPLING PART
23 LOCK BEAM
24 DISPLACEMENT REGULATING PART
26 DEFLECTION PART
27 FREE END
28 FIXED END
29 COUPLING PART
30 UPPER-SIDE INCLINED SURFACE (INCLINED SURFACE)
32 ENGAGEMENT PART
35 UNLOCKING MECHANISM
36 TORQUE GENERATION BEAM (TORQUE GENERATION MEANS)
36*a* FREE END
39 SECOND ENGAGEMENT PROJECTION (FREE END)
43 SECOND ENGAGEMENT PROJECTION (FREE END)
D Projecting Direction
E DIRECTION OPPOSITE TO PROJECTING DIRECTION
T TORQUE

DESCRIPTION OF THE EXEMPLARY EMBODIMENTS

First Exemplary Embodiment

A first exemplary embodiment of the present invention will now be described with reference to FIGS. 1A to 12B.

(Connector 1)

Figure 1A:
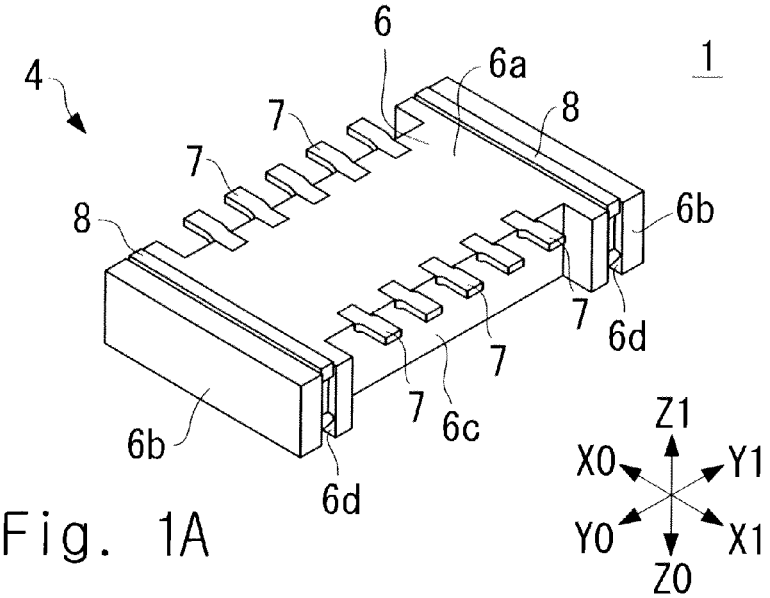
FIG. 1A is a perspective view of a plug connector according to a first exemplary embodiment seen from a substrate side.
Figure 1B:
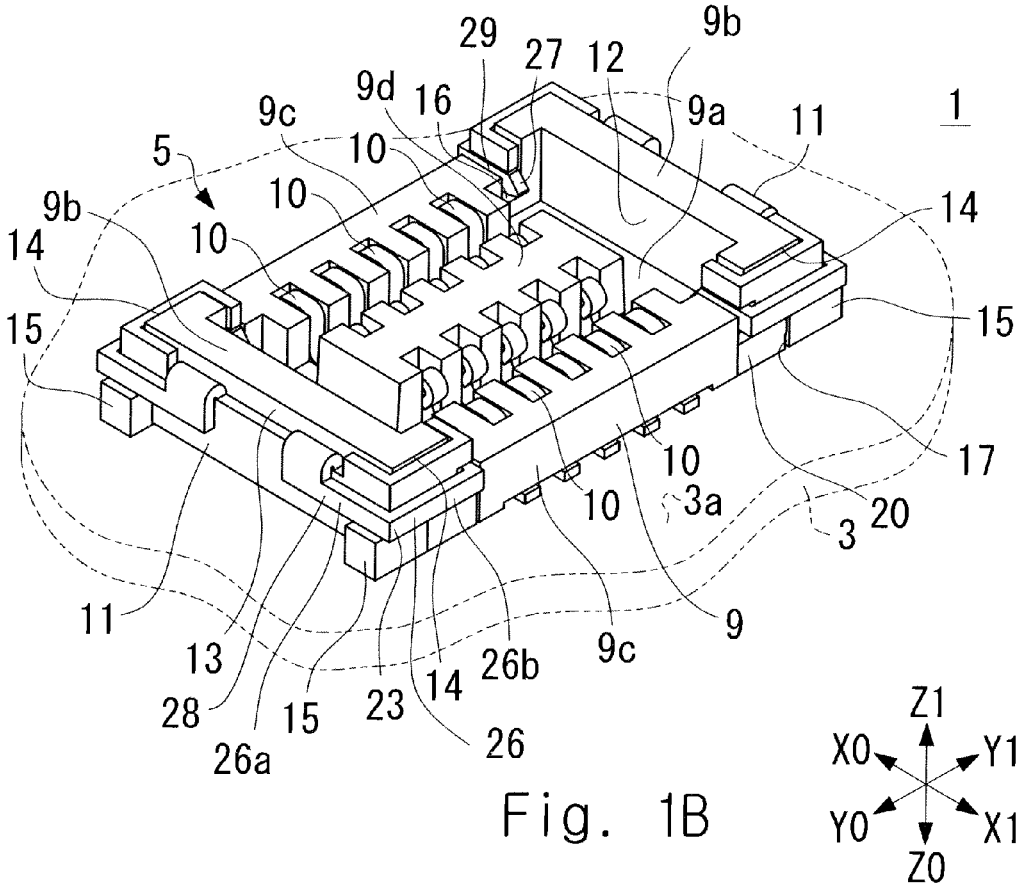
FIG. 1B is a perspective view of a receptacle connector according to the first exemplary embodiment seen from a coupling side.
Figure 2A:
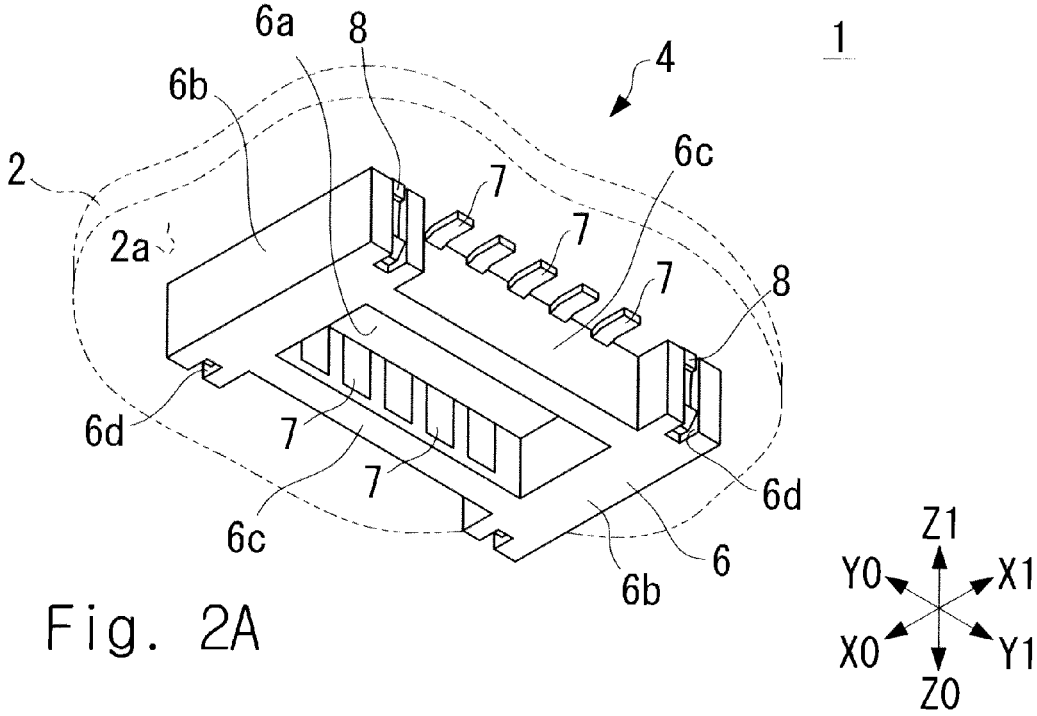
FIG. 2A is a perspective view of the plug connector seen from a coupling side.

A connector 1 (electrical connector) shown in FIGS. 1A, 1B, 2A, and 2B electrically connects a plug side substrate 2 (first substrate) such as a PCB (Printed Circuit Board), a PWB (Printed Wiring Board), an FPC (Flexible Printed Circuits), an FFC (Flexible Flat Cable) and a receptacle side substrate 3 (second substrate) such as a PCB, a PWB, an FPC, an FFC, for example. The connector 1 includes a plug connector 4 (first connector part) mounted on the plug side substrate 2 as shown in FIG. 2A, and a receptacle connector 5 (second connector part) mounted on the receptacle side substrate 3 as shown in FIG. 1B. The main application of the connector 1 is mobile communication devices represented by mobile phones. The general requirement in designing the connector 1 in this case is a reduction in height of the connector 1 itself.

The plug connector 4 includes, as shown in FIGS. 1A and 2A, an insulating plug housing 6 (first housing), a plurality of conductive plug contacts 7 (first contact) supported by the plug housing 6, and a pair of plug assistant fittings 8 (first assistant fitting) supported by the plug housing 6.

Figure 2B:
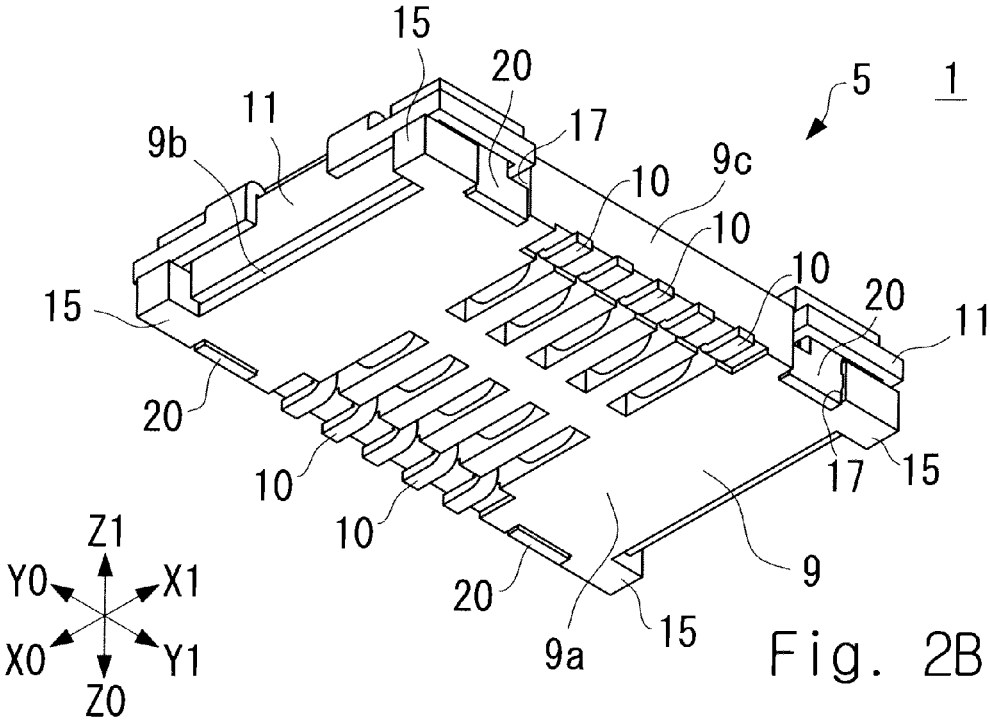
FIG. 2B is a perspective view of the receptacle connector seen from a substrate side.

The receptacle connector 5 includes, as shown in FIGS. 1B and 2B, an insulating receptacle housing 9 (second housing), a plurality of conductive receptacle contacts 10 (second contact) supported by the receptacle housing 9, and a pair of receptacle assistant fittings 11 (second assistant fitting) supported by the receptacle housing 9.

As shown in FIGS. 1A, 1B, 2A, and 2B, the receptacle housing 9 of the receptacle connector 5 is formed so as to be able to accommodate the plug housing 6 of the plug connector 4. By coupling the plug connector 4 and the receptacle connector 5 so as to accommodate the plug housing 6 in the receptacle housing 9, the plurality of plug contacts 7 of the plug connector 4 and the plurality of receptacle contacts 10 of the receptacle connector 5 are connected in one to one. Then, the plug assistant fittings 8 of the plug connector 4 and the receptacle assistant fittings 11 of the receptacle connector 5 function to secure a coupling strength between the plug connector 4 and the receptacle connector 5.

Now, the description will be made of directions X0, X1, Y0, Y1, Z0, and Z1 shown in each of the drawings. As shown in FIGS. 1A and 1B, the direction Z0 is a direction in which the plug connector 4 is coupled to the receptacle connector 5. The direction Z1 is opposite to the direction Z0, and is a direction in which the plug connector 4 is decoupled from the receptacle connector 5. The direction Y0 is a direction in which the plurality of receptacle contacts 10 (or plug contacts 7) are aligned. The direction Y1 is opposite to the direction Y0. The direction X0 is perpendicular to both of the direction Z0 and the direction Y0. The direction X1 is opposite to the direction X0.

(Receptacle Housing 9)

As shown in FIGS. 1B and 2B, the receptacle housing 9 is formed of a bottom wall 9*a* that is opposite to a connector mounting surface 3*a* of the receptacle side substrate 3, a pair of receptacle assistant fitting holding walls 9*b* that hold the bottom wall 9*a* in the direction Y0 and direction Y1, a pair of receptacle contact holding walls 9*c* that hold the bottom wall 9*a* in the direction X0 and the direction X1, and a contact holding projected part 9*d* that projects from the center of the bottom wall 9*a* in the direction Z1. The receptacle assistant fitting holding walls 9*b* and the receptacle contact holding walls 9*c* of the receptacle housing 9 make up an external wall of the receptacle housing 9.

Each of the receptacle assistant fitting holding walls 9*b* includes a front surface 12 which is a surface on the contact holding projected part 9*d* side, a rear surface 13 which is a surface on the opposite side of the contact holding projected part 9*d*, and a pair of side surfaces 14. Each of the receptacle assistant fitting holding walls 9*b* includes corner parts 15 near boundaries between the pair of side surfaces 14 and the rear surface 13. Further, a lock groove 16 is formed between the receptacle assistant fitting holding wall 9*b* and the receptacle contact holding walls 9*c* so as to penetrate in the direction X0 and the direction X1. Further, a fixed groove 17 is formed between the corner parts 15 and the receptacle contact holding walls 9*c* so as to penetrate in the direction Z0 and the direction Z1. The rear surface 13 and the side surfaces 14 of the receptacle assistant fitting holding wall 9*b* make up a part of an outer peripheral surface of the receptacle housing 9.

The plurality of receptacle contacts 10 are aligned in two lines in the receptacle connector 5, as shown in FIG. 1B. The receptacle contacts 10 are each disposed so as to straddle the receptacle contact holding wall 9*c* and the contact holding projected part 9*d*.

(Plug Housing 6)

As shown in FIGS. 1A and 2A, the plug housing 6 is formed of a bottom wall 6*a* that is opposite to the connector mounting surface 2*a* of the plug side substrate 2, a pair of plug assistant fitting holding walls 6*b* that hold the bottom wall 6*a* in the direction Y0 and the direction Y1, and a pair of plug contact holding walls 6*c* that hold the bottom wall 6*a* in the direction X0 and the direction X1. The plurality of plug contacts 7 are held in two lines in each of the plug contact holding walls 6*c* as shown in FIG. 2A. The plug assistant fitting holding walls 6*b* each include a plug assistant fitting holding groove 6*d* formed to hold the plug assistant fitting 8 formed therein.

When the plug connector 4 and the receptacle connector 5 are coupled to each other, the plug housing 6 is accommodated in the receptacle housing 9. More specifically, the plug assistant fitting holding walls 6*b* of the plug housing 6 are each inserted between the contact holding projected part 9*d* and the receptacle assistant fitting holding wall 9*b* of the receptacle housing 9. Each plug contact holding wall 6*c* of the plug housing 6 is inserted between the contact holding projected part 9*d* and the receptacle contact holding wall 9*c* of the receptacle housing 9. As a result, as described above, the plurality of plug contacts 7 aligned in two lines in the plug housing 6 and the plurality of receptacle contacts 10 aligned in two lines in the receptacle housing 9 are connected in one to one.

(Receptacle Assistant Fitting 11)

Figure 3A:
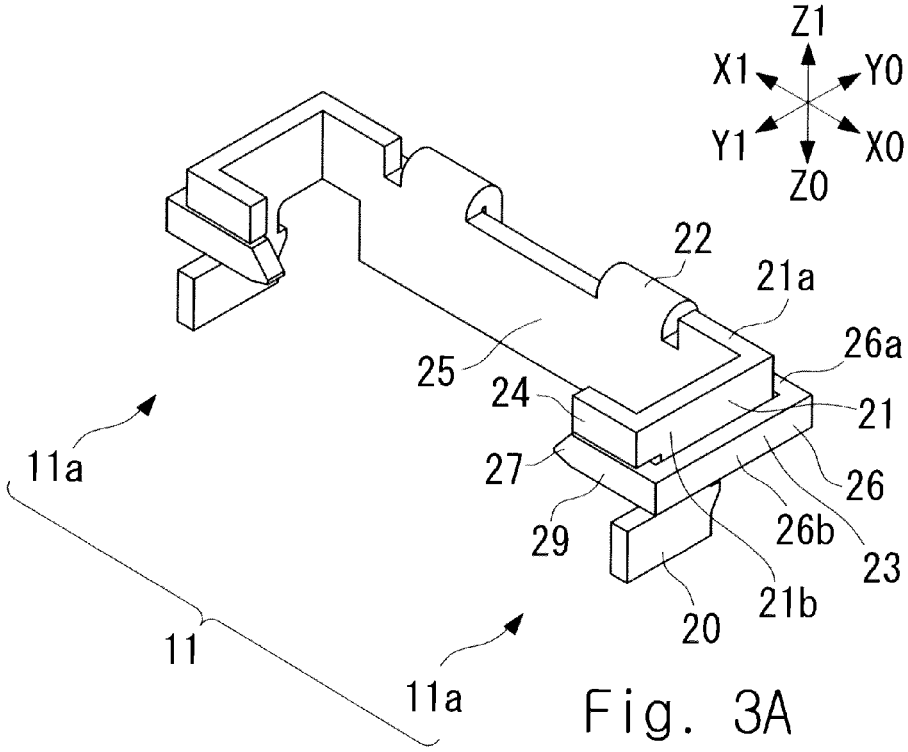
FIGS. 3A and 3B are perspective views of a receptacle assistant fitting seen from a coupling side.
Figure 3B:
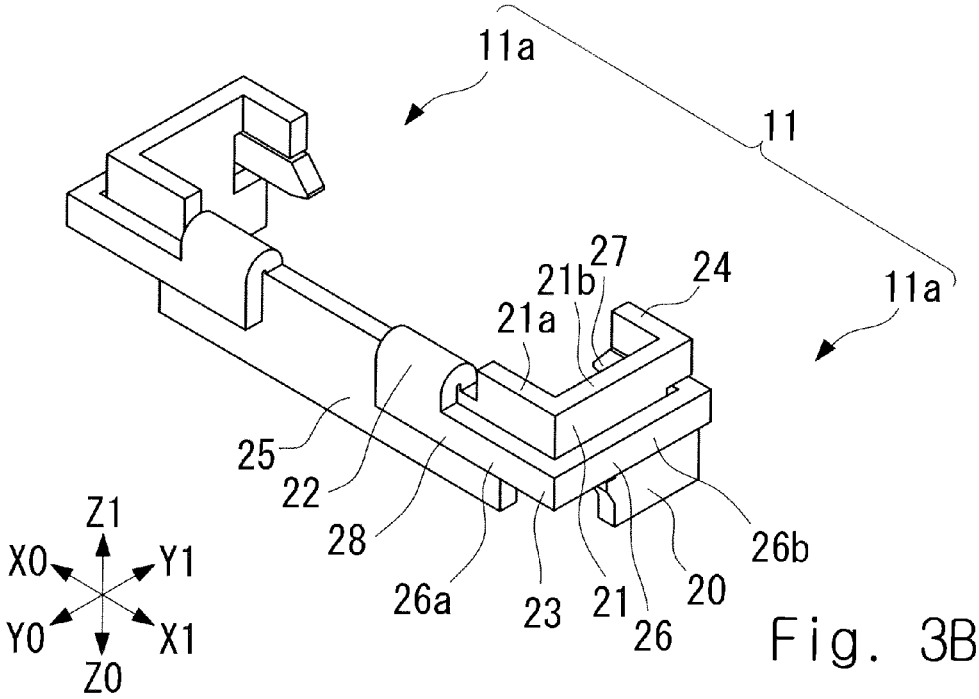

Next, the receptacle assistant fitting 11 will be described with reference to FIGS. 1 to 4. The receptacle assistant fitting 11 is formed, as shown in FIGS. 3A and 3B, by folding a plate obtained by stamping a metal thin plate in a certain shape at a certain position. Since the receptacle assistant fitting 11 is line-symmetrical in the directions X0 and X1 as shown in FIG. 3A and so on, a receptacle assistant fitting part 11*a* obtained by dividing the receptacle assistant fitting 11 in half in the directions X0 and X1 will now be described.

The receptacle assistant fitting part 11*a* mainly includes a substrate ground part 20, a lock beam support part 21, a lock beam coupling part 22, a lock beam 23, a displacement regulating part 24, and a stabilizer 25.

Figure 4:
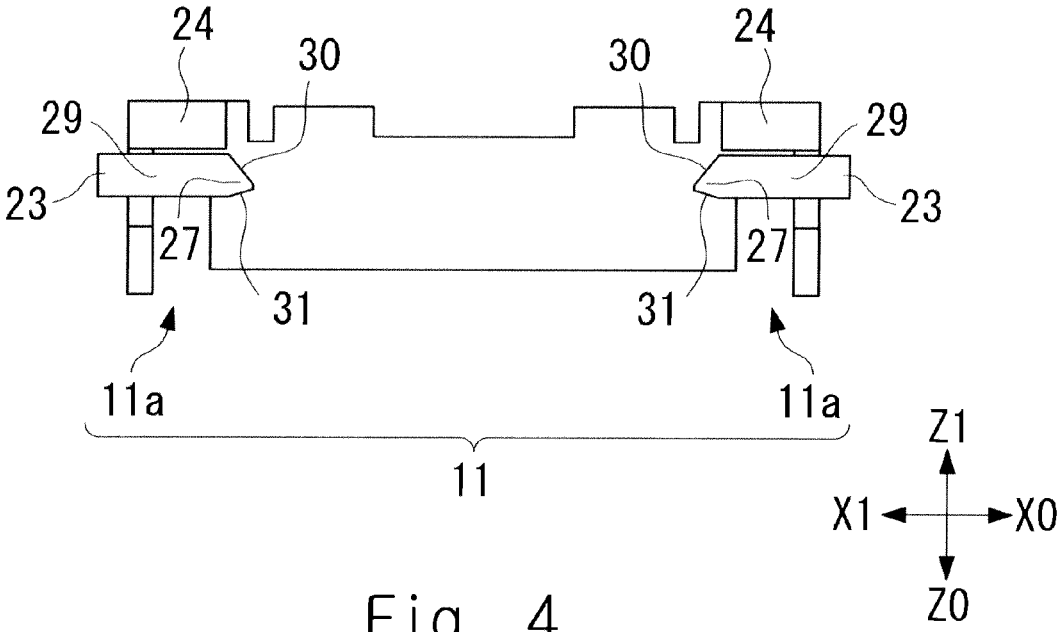
FIG. 4 is a front view of the receptacle assistant fitting.

The lock beam 23 is, as shown in FIG. 1B, a cantilever having a deflection part 26 extending in a direction substantially parallel to the connector mounting surface 3*a* of the receptacle side substrate 3 in the outside of the receptacle housing 9, and the lock beam 23 includes the free end 27 and a fixed end 28 as shown in FIG. 3B. The lock beam 23 includes the deflection part 26 and a coupling part 29. The deflection part 26 is composed of, as shown in FIG. 1B, a rear surface side deflection part 26*a* that extends on the side surface 14 side along the rear surface 13 from the fixed end 28 located at a certain position of the rear surface 13 of the receptacle assistant fitting holding wall 9*b* of the receptacle housing 9, and a side surface side deflection part 26*b* that extends on the receptacle contact holding wall 9*c* side along the side surface 14 from the end of the rear surface side deflection part 26*a*. The free end 27 projects inside the receptacle housing 9 as shown in FIG. 1B. The deflection part 26 and the free end 27 are coupled to each other by the coupling part 29, and the coupling part 29 is accommodated in the lock groove 16 shown in FIG. 1B. The free end 27 is tapered toward the direction X0 and the direction X1, as shown in FIG. 4. The free end 27 includes an upper-side inclined surface 30 whose normal direction is close to the direction Z1, and a lower-side inclined surface 31 whose normal direction is close to the direction Z0. The part between the upper-side inclined surface 30 and the lower-side inclined surface 31 is somewhat rounded.

The substrate ground part 20 is pressed into the fixed groove 17 shown in FIGS. 1B and 2B, and is soldered to the connector mounting surface 3*a* of the receptacle side substrate 3 shown in FIG. 1B. The substrate ground part 20 is to fix the receptacle housing 9 to the connector mounting surface 3*a* of the receptacle side substrate 3.

As shown in FIG. 3B, the lock beam support part 21 is connected to the substrate ground part 20 and extends between the lock beam 23 and the receptacle assistant fitting holding wall 9*b* from the substrate ground part 20 to the fixed end 28 of the lock beam 23 along with the lock beam 23 (see also FIG. 1B). In short, the lock beam 23 extends on the outside of the lock beam support part 21. The lock beam support part 21 is composed of a rear surface side lock beam support part 21*a* that extends along with the rear surface side deflection part 26*a*, and a side surface side lock beam support part 21*b* that extends along with the side surface side deflection part 26*b*. The lock beam coupling part 22 couples the lock beam support part 21 to the fixed end 28 of the lock beam 23. In the first exemplary embodiment, the lock beam coupling part 22 couples an upper end of the lock beam support part 21 and an upper end of the fixed end 28 of the lock beam 23. In this structure, the lock beam 23 is supported by the substrate ground part 20. More specifically, the lock beam 23 is indirectly supported by the substrate ground part 20 through the lock beam support part 21 and the lock beam coupling part 22.

The displacement regulating part 24 regulates displacement of the free end 27 of the lock beam 23 in the direction Z1. As shown in FIG. 3A, the displacement regulating part 24 is integrally coupled to the substrate ground part 20 through the side surface side lock beam support part 21*b*, and is formed near the substrate ground part 20. Then, the displacement regulating part 24 is formed adjacent to the coupling part 29 in the direction Z1. The substrate ground part 20 fixes the displacement regulating part 24 to the connector mounting surface 3*a* of the receptacle side substrate 3, thereby exhibiting the function of regulating the displacement of the displacement regulating part 24 itself. The direction Z1 corresponds to the direction in which the plug housing 6 is removed from the receptacle housing 9, as shown in FIGS. 1A and 1B.

(Plug Assistant Fitting 8)

Figure 5A:
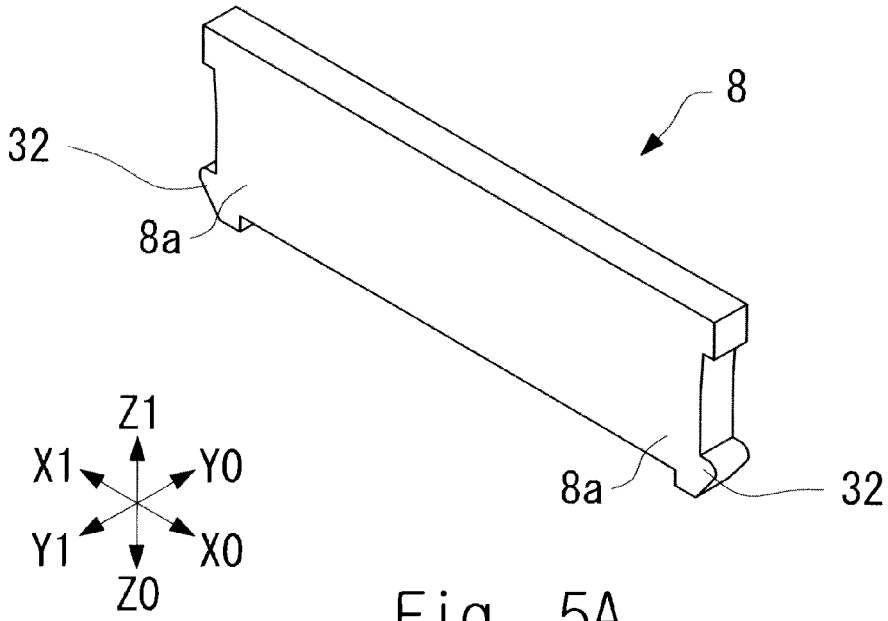
FIG. 5A is a perspective view of a plug assistant fitting.
Figure 5B:
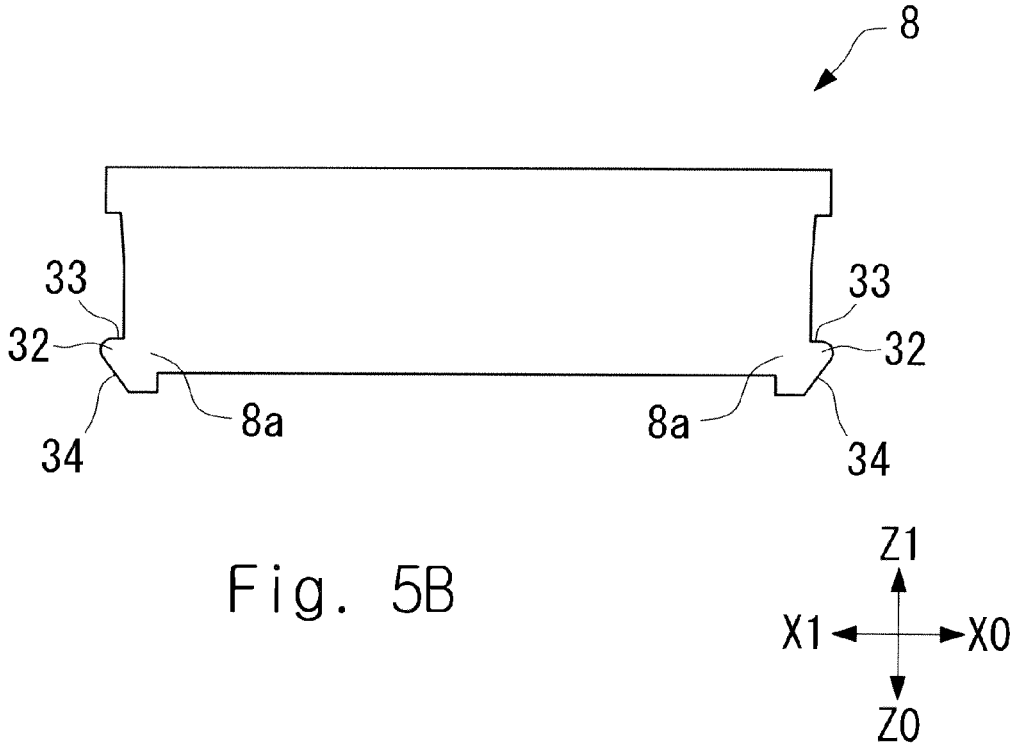
FIG. 5B is a front view of the plug assistant fitting.

The plug assistant fitting 8 is obtained by stamping a metal thin plate in a certain shape as shown in FIGS. 5A and 5B. The plug assistant fitting 8 has substantially a rectangular shape, and includes an engagement part 32 formed in each of a pair of corner parts 8*a* in the direction Z0. Each of the engagement parts 32 pushes aside the free end 27 of the lock beam 23 and rides over the free end 27 of the lock beam 23, so as to be engaged with the free end 27 of the lock beam 23, when the plug connector 4 and the receptacle connector 5 are coupled to each other, as shown in FIGS. 6 to 9. Each of the engagement parts 32 is tapered toward the direction X0 and the direction X1, and includes an upper engagement surface 33 whose normal direction is equal to the direction Z1 and a lower-side inclined surface 34 whose normal direction is close to the direction Z0.

(Operation when Connector 1 is Coupled)

Figure 6A:
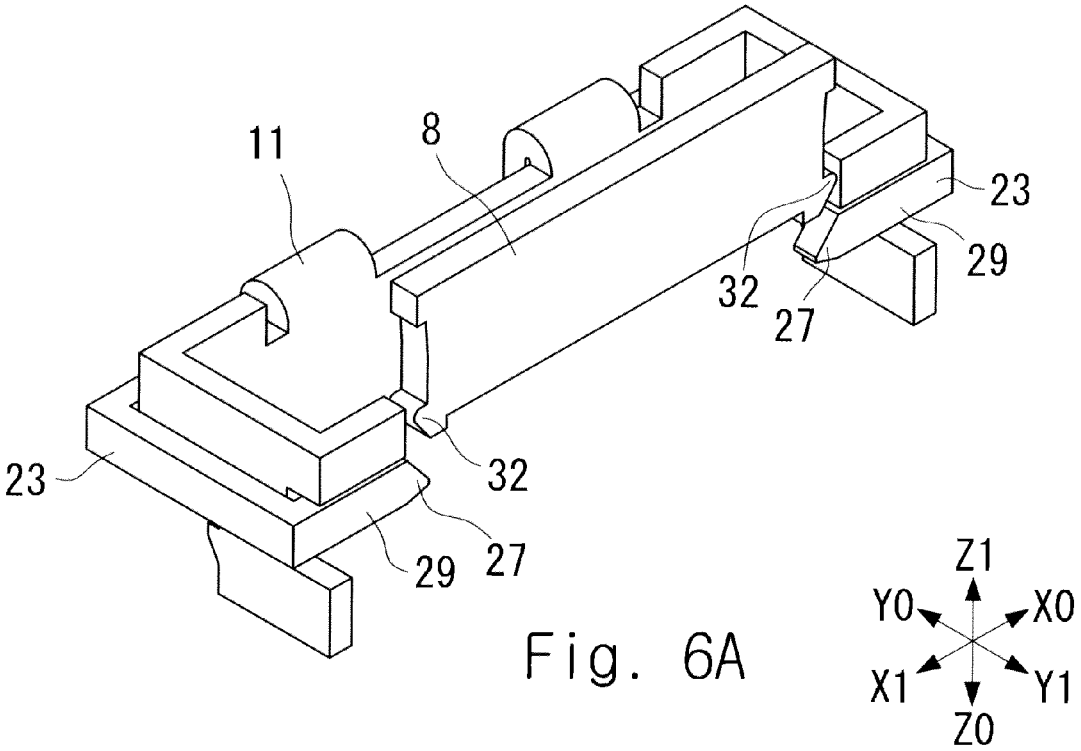
FIGS. 6A and 6B are operation diagrams explaining coupling of a connector.
Figure 6B:
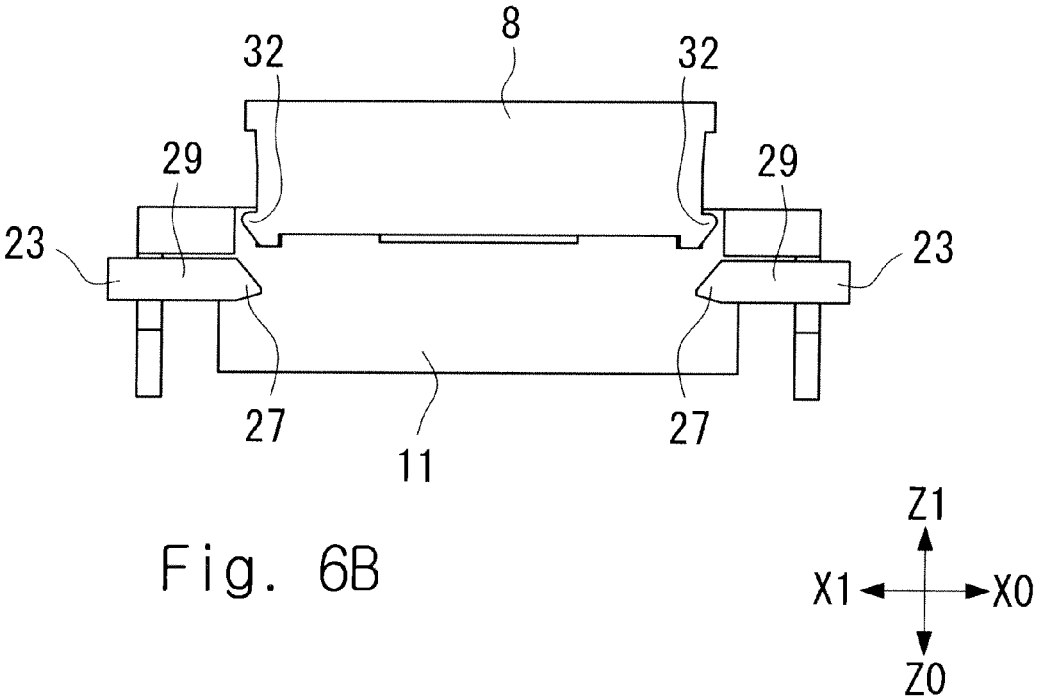

Next, an operation when the connector 1 is coupled will be described with reference to FIGS. 6A to 9B. First, when the plug housing 6 is inserted into the receptacle housing 9 in a direction shown in FIGS. 1A and 1B, the engagement parts 32 of the plug assistant fitting 8 and the free ends 27 of the lock beams 23 of the receptacle assistant fitting 11 are opposed to each other in the direction Z1 and the direction Z0 due to a positioning action of the plug housing 6 and the receptacle housing 9 as shown in FIGS. 6A and 6B.

Figure 7A:
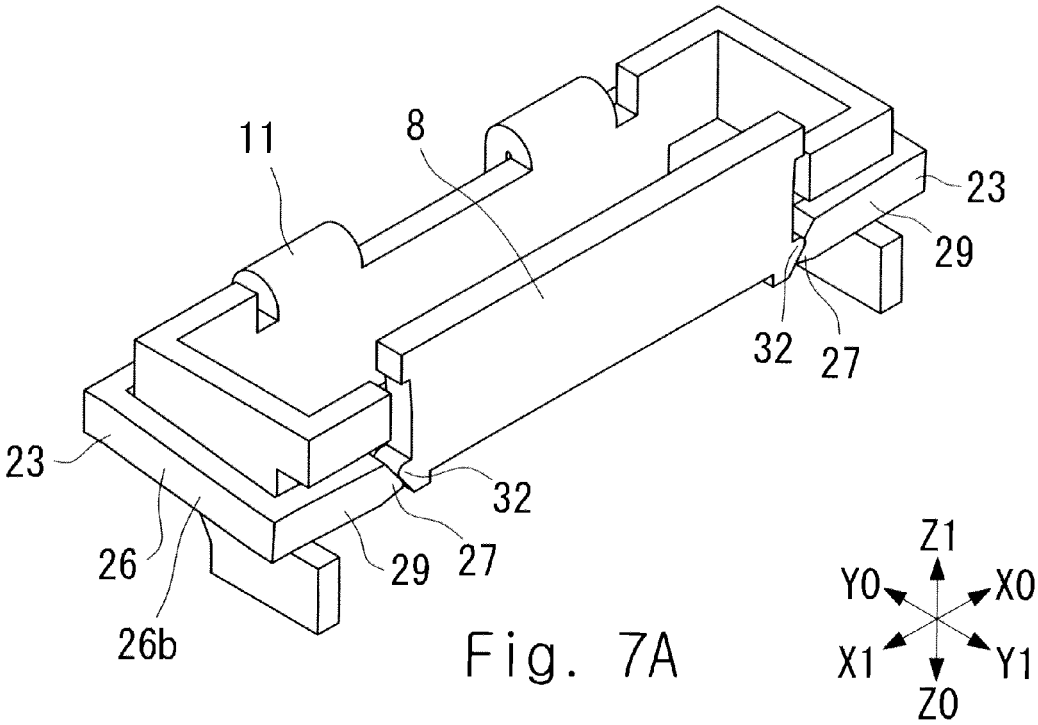
FIGS. 7A and 7B are operation diagrams explaining the coupling of the connector.
Figure 7B:
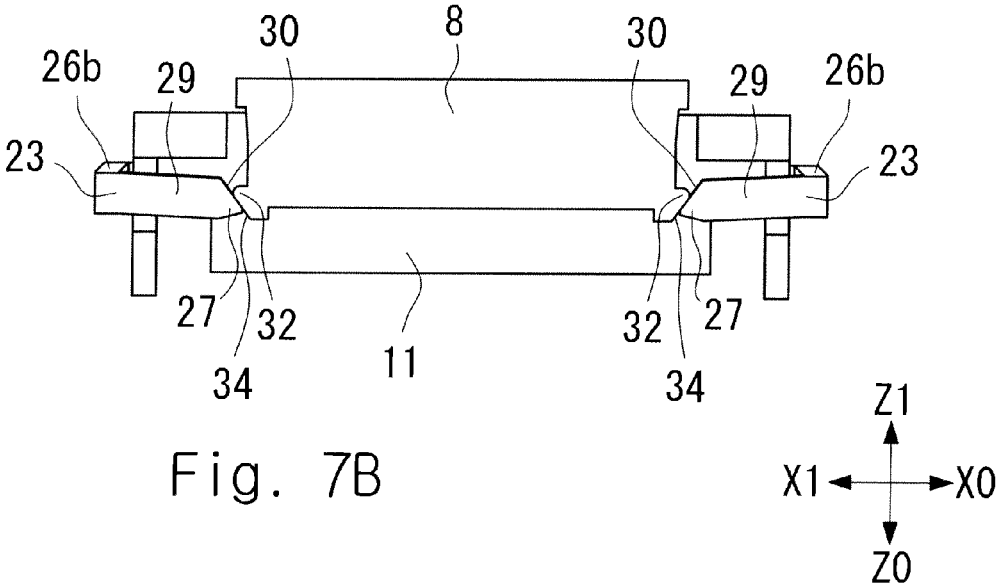

When the plug housing 6 is further inserted into the receptacle housing 9, as shown in FIGS. 7A and 7B, the lower-side inclined surfaces 34 of the engagement parts 32 of the plug assistant fitting 8 contact with the upper-side inclined surfaces 30 of the free ends 27 of the lock beams 23 of the receptacle assistant fitting 11, and the engagement parts 32 push down the free ends 27. At this time, slipping is caused between the lower-side inclined surfaces 34 of the engagement parts 32 and the upper-side inclined surfaces 30 of the free ends 27, and the coupling parts 29 are somewhat withdrawn in the direction X1 and the direction X0 as shown in FIG. 7B. Furthermore, since the free ends 27 are pushed down by the engagement parts 32 in a position apart from the side surface side deflection parts 26*b* in the direction X1 and the direction X0, torsion occurs in the side surface side deflection parts 26*b*.

Figure 8A:
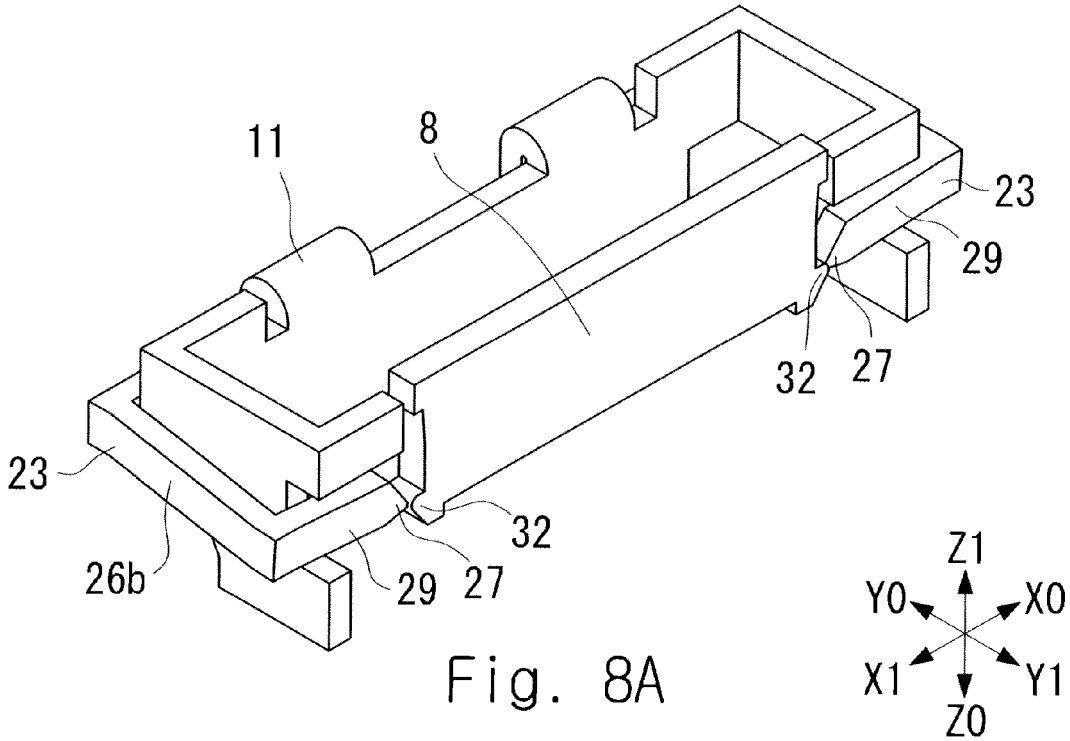
FIGS. 8A and 8B are operation diagrams explaining the coupling of the connector.
Figure 8B:
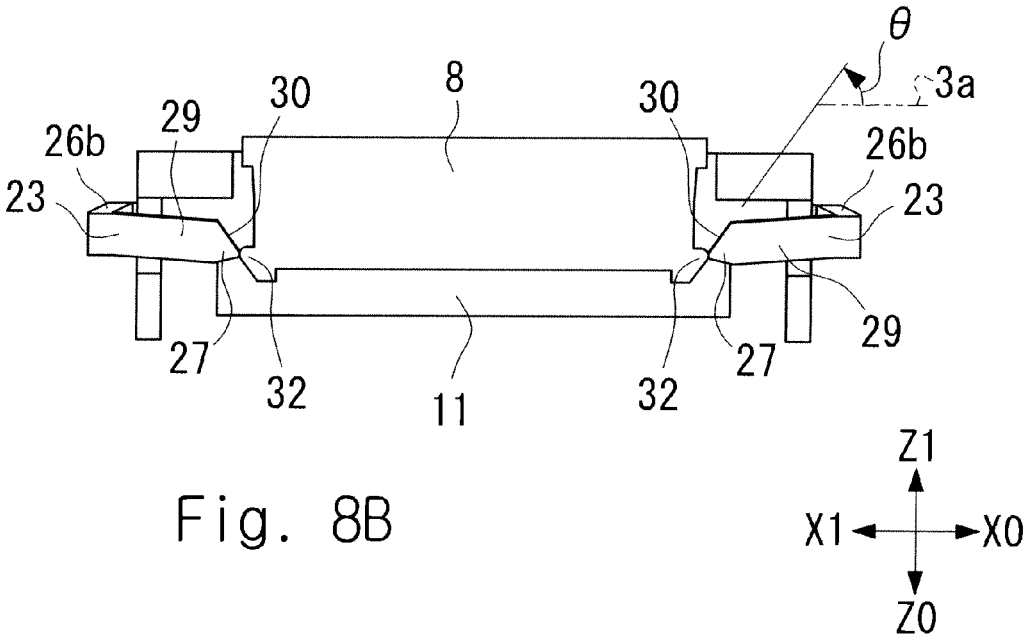

When the plug housing 6 is further inserted into the receptacle housing 9, as shown in FIGS. 8A and 8B, further torsion is caused in the side surface side deflection parts 26*b*, resulting in the coupling parts 29 greatly inclined so as to make the free ends 27 lower in the direction Z0. This inclination of the coupling parts 29 increases an inclination angle θ of the upper-side inclined surface 30 specified by the upper-side inclined surface 30 of the free end 27 and the connector mounting surface 3*a* of the receptacle side substrate 3. The inclination angle θ of the upper-side inclined surface 30 increases, which reduces the resistance force in the direction Z1 that the engagement parts 32 receive from the free ends 27 when the plug housing 6 is inserted into the receptacle housing 9.

Figure 9A:
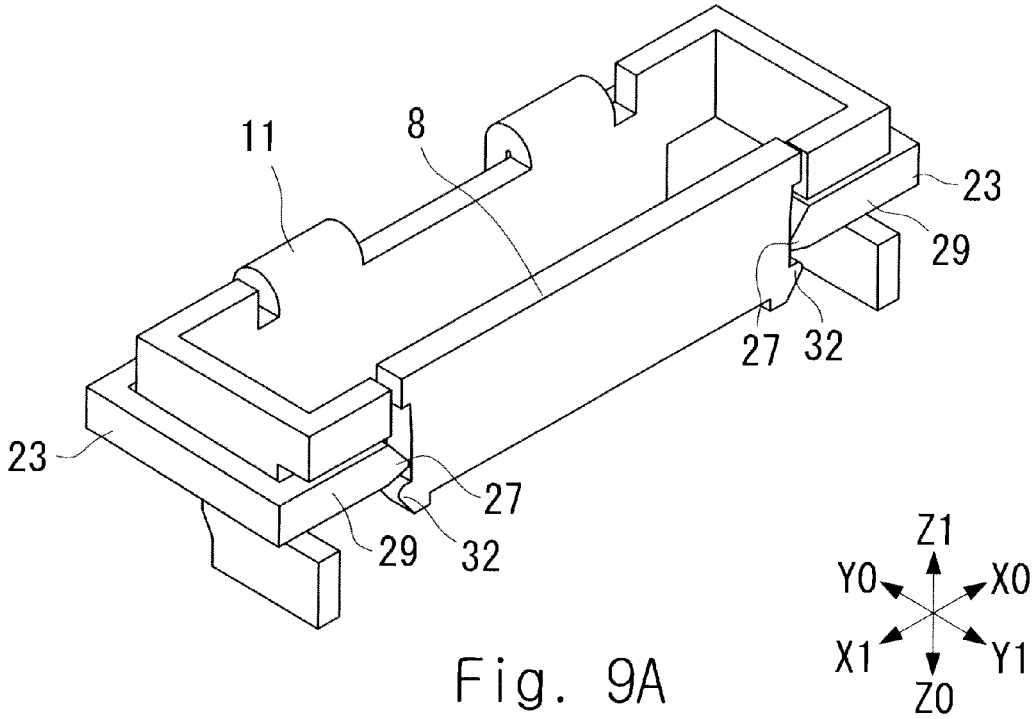
FIGS. 9A and 9B are operation diagrams explaining the coupling of the connector.
Figure 9B:
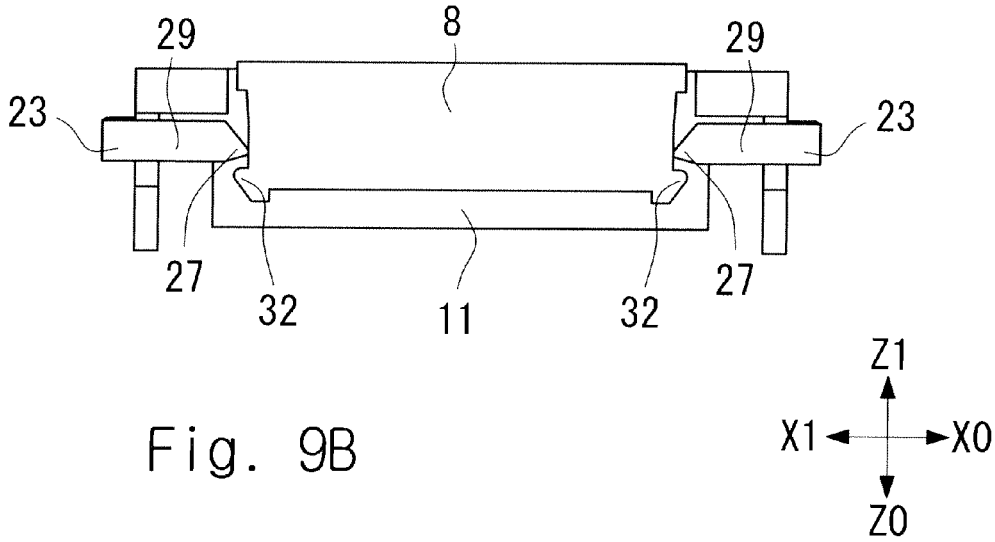

When the plug housing 6 is further inserted into the receptacle housing 9, the engagement parts 32 push aside the free ends 27 of the lock beams 23 and ride over the free ends 27 of the lock beams 23, so as to be engaged with the free ends 27 of the lock beams 23 as shown in FIGS. 9A and 9B. In other words, the engagement parts 32 ride over the free ends 27 of the lock beams 23, and are opposed to the free ends 27 of the lock beams 23 in the direction Z0 and the direction Z1. Thus, the operation to couple the connector 1 is completed. In the first exemplary embodiment, the free ends 27 of the lock beams 23 of the receptacle assistant fitting 11 contact with the plug assistant fitting 8. In summary, in the state shown in FIG. 9B, the lock beams 23 of the receptacle assistant fitting 11 are somewhat withdrawn in the direction X1 and the direction X0 compared with the state before the coupling of the connector 1 as shown in FIG. 6B.

(Operation when Connector 1 is Decoupled)

Figure 10A:
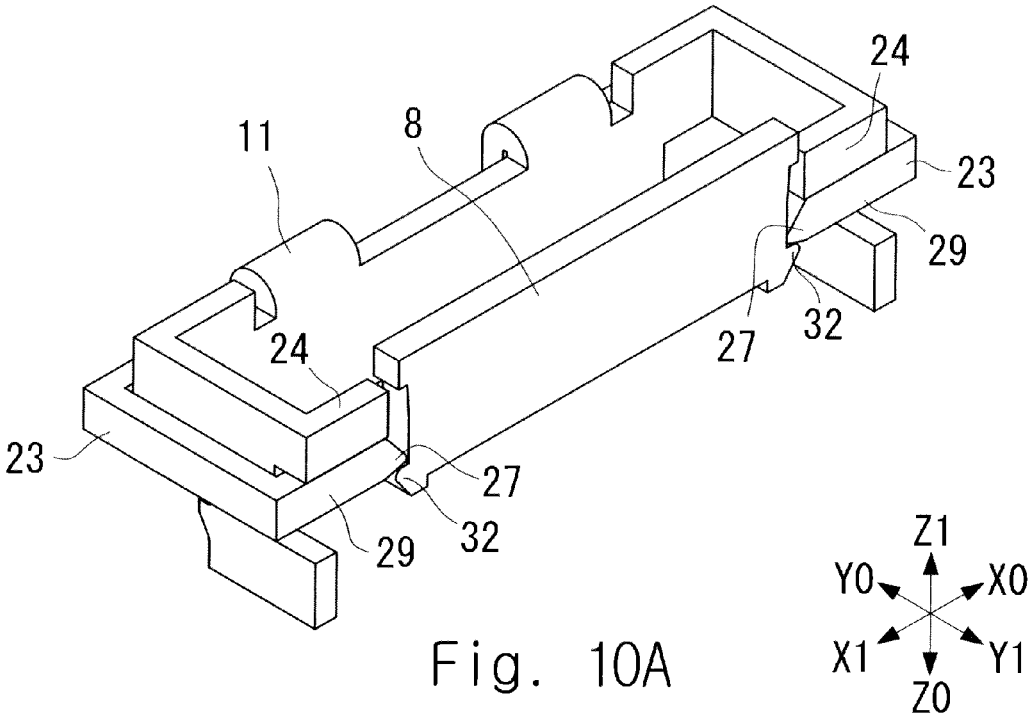
FIGS. 10A and 10B are operation diagrams explaining decoupling of the connector.
Figure 10B:
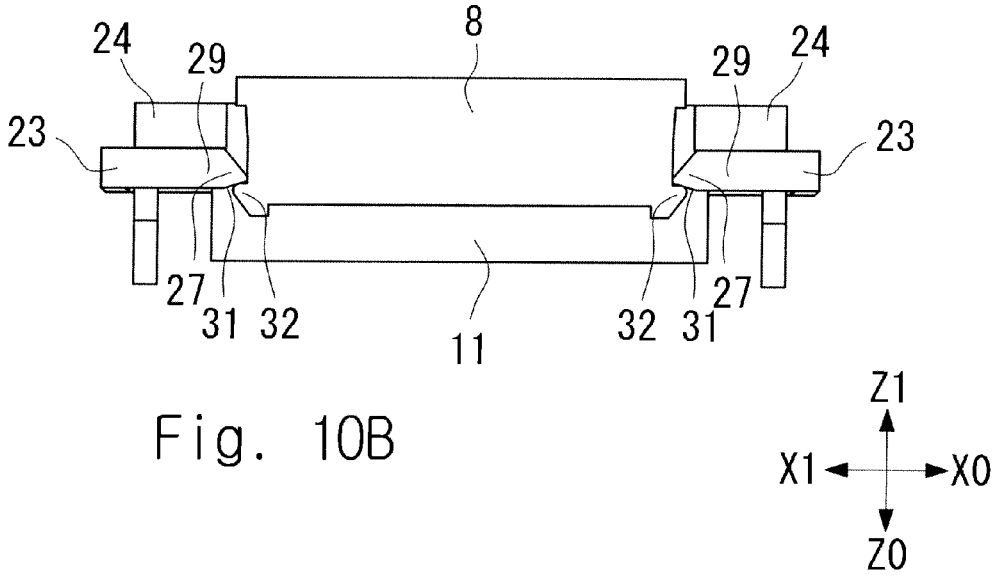

Next, an operation when the connector 1 is decoupled will be described with reference to FIGS. 10A to 12B. First, when the plug housing 6 of the plug connector 4 is pulled up in the direction Z1, as shown in FIGS. 10A and 10B, the engagement parts 32 of the plug assistant fitting 8 contact with the lower-side inclined surfaces 31 of the free ends 27 of the lock beams 23, and the engagement parts 32 tend to push up the free ends 27. However, since the displacement regulating parts 24 strongly fixed to the connector mounting surface 3*a* of the receptacle side substrate 3 by the substrate ground parts 20 are adjacent to the coupling parts 29 on the side of the direction Z1, the engagement parts 32 are prevented from pushing up the free ends 27.

Figure 11A:
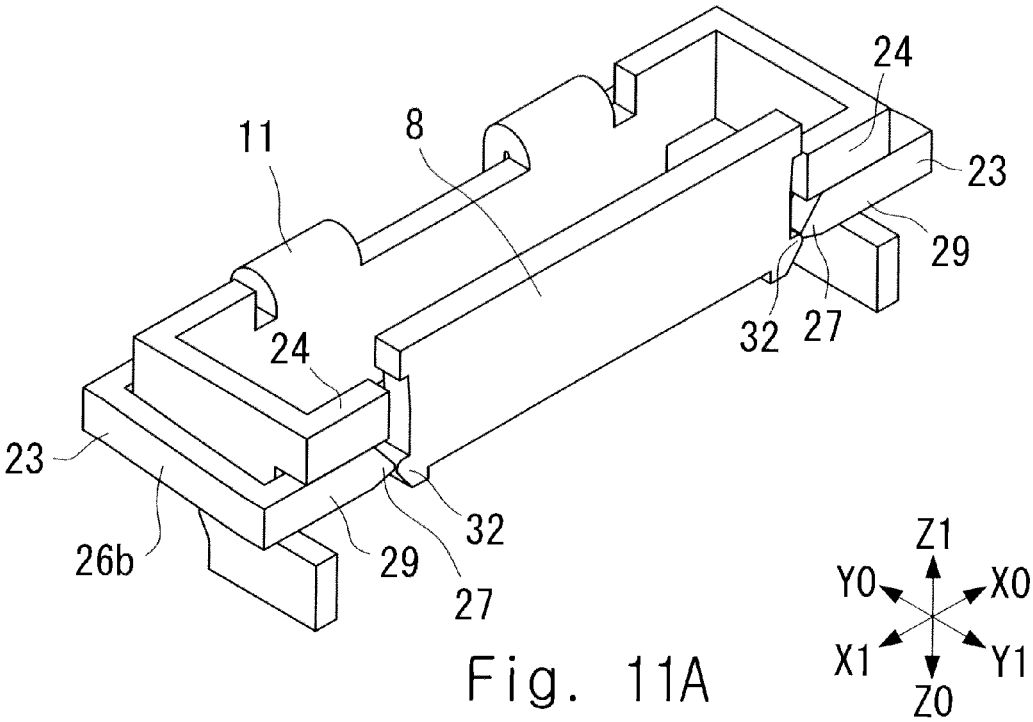
FIGS. 11A and 11B are operation diagrams explaining the decoupling of the connector.
Figure 11B:
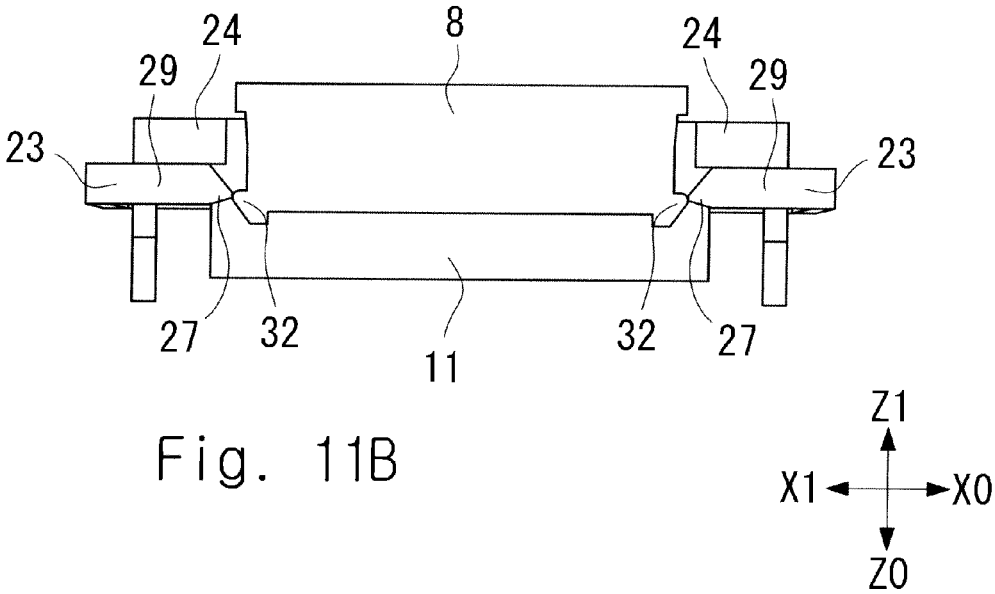

Subsequently, when the plug housing 6 of the plug connector 4 is pulled up in the direction Z1, slipping is caused between the engagement parts 32 and the lower-side inclined surfaces 31 of the free ends 27, and the coupling parts 29 are greatly withdrawn in the direction X1 and the direction X0 as shown in FIGS. 11A and 11B. At this time, since the free ends 27 are not pushed up, no torsion is caused in the side surface side deflection parts 26*b*.

Figure 12A:
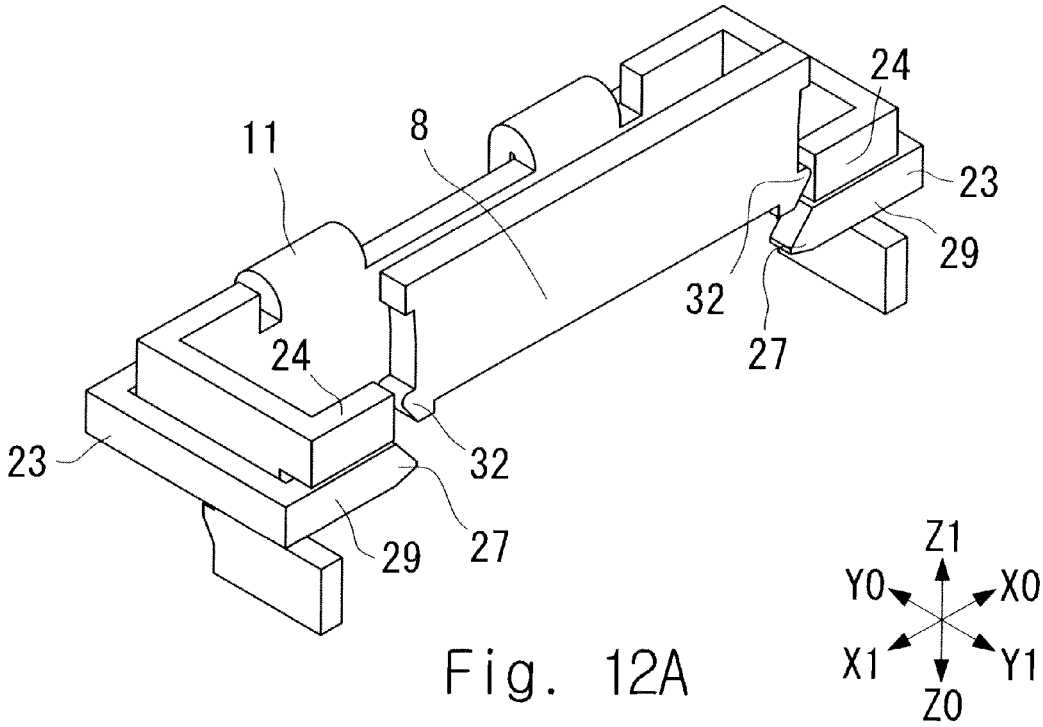
FIGS. 12A and 12B are operation diagrams explaining the decoupling of the connector.
Figure 12B:
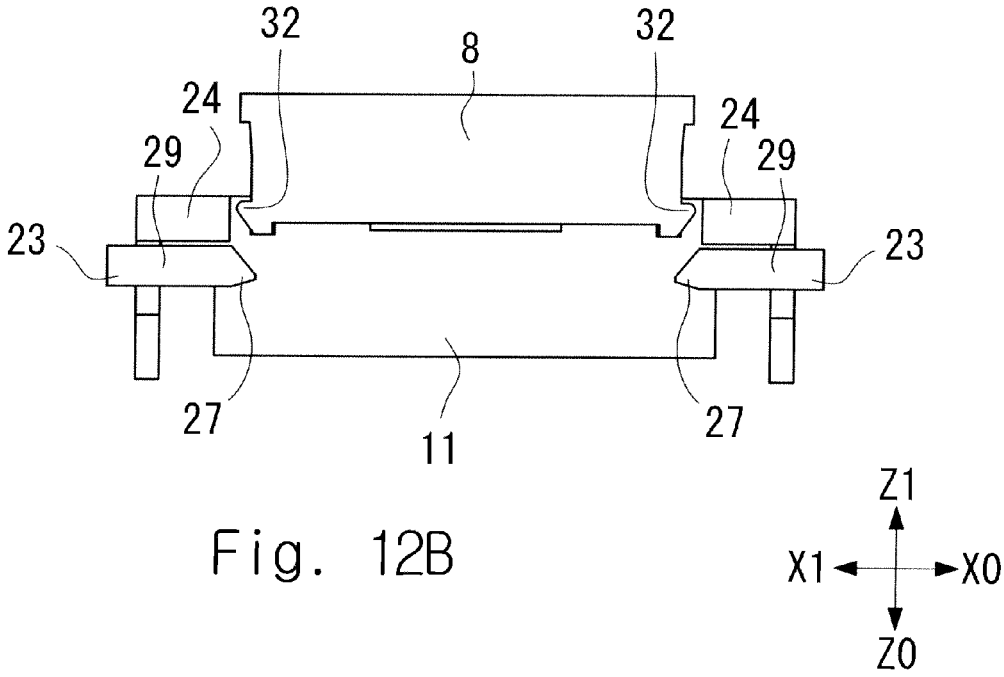

Subsequently, when the plug housing 6 of the plug connector 4 is pulled up in the direction Z1, the engagement parts 32 ride over the free ends 27, and the operation to decouple the connector 1 is completed as shown in FIGS. 12A and 12B.

(Summary)

As described above, in the first exemplary embodiment, the connector 1 is formed as follows as shown in FIGS. 1A to 9B. The connector 1 includes the plug housing 6, the plug contact 7 supported by the plug housing 6, the plug connector 4 mounted on the plug side substrate 2, the receptacle housing 9 that can accommodate the plug housing 6, the receptacle contact 10 supported by the receptacle housing 9, and the receptacle connector 5 mounted on the receptacle side substrate 3. By coupling the plug connector 4 and the receptacle connector 5 so as to accommodate the plug housing 6 within the receptacle housing 9, the plug contacts 7 contact with the receptacle contacts 10. The plug connector 4 and the receptacle connector 5 are provided with the plug assistant fittings 8 and the receptacle assistant fittings 11, respectively, in order to secure the coupling strength between the plug connector 4 and the receptacle connector 5. The receptacle assistant fitting 11 of the receptacle connector 5 includes the cantilevered lock beams 23 each including the deflection part 26 extending in the direction substantially parallel to the connector mounting surface 3*a* of the receptacle side substrate 3 in the outside of the receptacle housing 9. The plug assistant fitting 8 of the plug connector 4 includes the engagement parts 32 that push aside the free ends 27 of the lock beams 23 and ride over the free ends 27 of the lock beams 23 to be engaged with the free ends 27 of the lock beams 23 when the plug connector 4 and the receptacle connector 5 are coupled to each other. As stated above, since the receptacle assistant fitting 11 includes the cantilevered lock beams 23 that include the deflection parts 26 extending in the direction substantially parallel to the connector mounting surface 3*a* of the receptacle side substrate 3 in the outside of the receptacle housing 9, the following effects can be obtained compared with the lock part disclosed in the patent document 1. In short, the lock beams 23 can be easily deflected since sufficient beam length can be secured. If the lock beams 23 are easily deflected, the engagement parts 32 of the plug assistant fitting 8 can easily push aside the free ends 27 of the lock beams 23. Accordingly, the configuration stated above reduces the force required to couple the plug connector 4 and the receptacle connector 5.

Further, as shown in FIG. 1B, the deflection parts 26 of the lock beams 23 extend along the outer peripheral surface of the receptacle housing 9 (rear surface 13, side surface 14, and so on). The free ends 27 of the lock beams 23 project inside the receptacle housing 9. According to the configuration stated above, when the engagement parts 32 of the plug assistant fitting 8 push aside the free ends 27 of the lock beams 23, torsion is occurred in addition to the simple bending in the deflection parts 26 of the lock beams 23. The bending and the torsion are concurrently occurred in the deflection parts 26 of the lock beams 23, and the displacement of the free ends 27 of the lock beams 23 is further facilitated. Since the free ends 27 of the lock beams 23 are easily displaced, the engagement parts 32 of the plug assistant fitting 8 easily push aside the free ends 27 of the lock beams 23. Accordingly, the configuration as stated above further reduces the force required to couple the plug connector 4 and the receptacle connector 5.

Further, as shown in FIG. 4, the free ends 27 of the lock beams 23 have the upper-side inclined surfaces 30 formed therein to allow the engagement parts 32 of the plug assistant fitting 8 to easily push aside the free ends 27 of the lock beams 23. The configuration stated above further reduces the force required to couple the plug connector 4 and the receptacle connector 5. Notably, since the torsion occurred in the deflection parts 26 of the lock beams 23 increases the inclination angle θ of the upper-side inclined surfaces 30 with respect to the connector mounting surface 3*a*, the resistance force that the engagement parts 32 of the plug assistant fitting 8 receives from the free ends 27 of the lock beams 23 when the plug connector 4 and the receptacle connector 5 are coupled is automatically reduced. In this sense as well, the force required to couple the plug connector 4 and the receptacle connector 5 can be further reduced. In summary, the torsion occurred in the deflection parts 26 of the lock beams 23 not only facilitates the displacement of the free ends 27 of the lock beams 23, but also varies the inclination angle θ of the upper-side inclined surfaces 30, which is a specific technical feature.

Furthermore, as shown in FIG. 4, the connector 1 further includes the displacement regulating parts 24 that regulate the displacement of the free ends 27 of the lock beams 23 in the direction in which the plug housing 6 is removed from the receptacle housing 9. According to the configuration stated above, when the plug housing 6 is removed from the receptacle housing 9, the occurrence of torsion in the deflection parts 26 of the lock beams 23 is prohibited. Accordingly, when the plug connector 4 and the receptacle connector 5 are decoupled, the free ends 27 of the lock beams 23 are hardly displaced compared with the case in which the plug connector 4 and the receptacle connector 5 are coupled to each other. Hence, the configuration as stated above achieves the connector 1 that is capable of reducing the force required to couple the plug connector 4 and the receptacle connector 5 and sufficiently securing the force required to decouple the plug connector 4 and the receptacle connector 5.

Further, as shown in FIG. 4, the displacement regulating parts 24 are formed as a part of the receptacle assistant fitting 11. Alternatively, however, instead of this structure, the displacement regulating parts 24 may be integrally formed with the receptacle housing 9.

Further, as shown in FIG. 3A, the receptacle assistant fitting 11 further includes the substrate ground parts 20 that regulate the displacement of the displacement regulating parts 24 itself by fixing the substrate ground parts 20 to the connector mounting surface 3*a* of the receptacle side substrate 3. According to the structure as described above, it is possible to efficiently regulate the displacement of the free ends 27 of the lock beams 23 in the direction in which the plug housing 6 is removed from the receptacle housing 9.

Further, as shown in FIG. 3A, the substrate ground parts 20 of the receptacle assistant fitting 11 are formed near the displacement regulating parts 24. According to the structure described above, the displacement of the displacement regulating parts 24 itself can be regulated more efficiently compared with the case in which the substrate ground parts 20 of the receptacle assistant fitting 11 are formed to be away from the displacement regulating parts 24.

As shown in FIGS. 3A and 3B, the lock beams 23 are supported by the substrate ground parts 20. The receptacle assistant fitting 11 further includes the lock beam support part 21 and the lock beam coupling parts 22. The lock beam support part 21 is connected to the substrate ground parts 20 and extends from the substrate ground parts 20 toward the fixed ends 28 of the lock beams 23 along with the lock beams 23, and the lock beam coupling parts 22 couple the lock beam support part 21 to the fixed ends 28 of the lock beams 23. In summary, the substrate ground parts 20 are located near the displacement regulating parts 24, and the displacement regulating parts 24 are located near the free ends 27 of the lock beams 23. Thus, the substrate ground parts 20 are located near the free ends 27 of the lock beams 23. When the lock beams 23 are supported by the substrate ground parts 20 with such a structure, the beam length of the lock beams 23 can be hardly secured. According to the configuration stated above, the lock beams 23 are indirectly supported by the substrate ground parts 20 through the lock beam coupling parts 22 and the lock beam support part 21, and thus sufficient beam length of the lock beams 23 can be secured without any problem.

Second Exemplary Embodiment

Figure 13A:
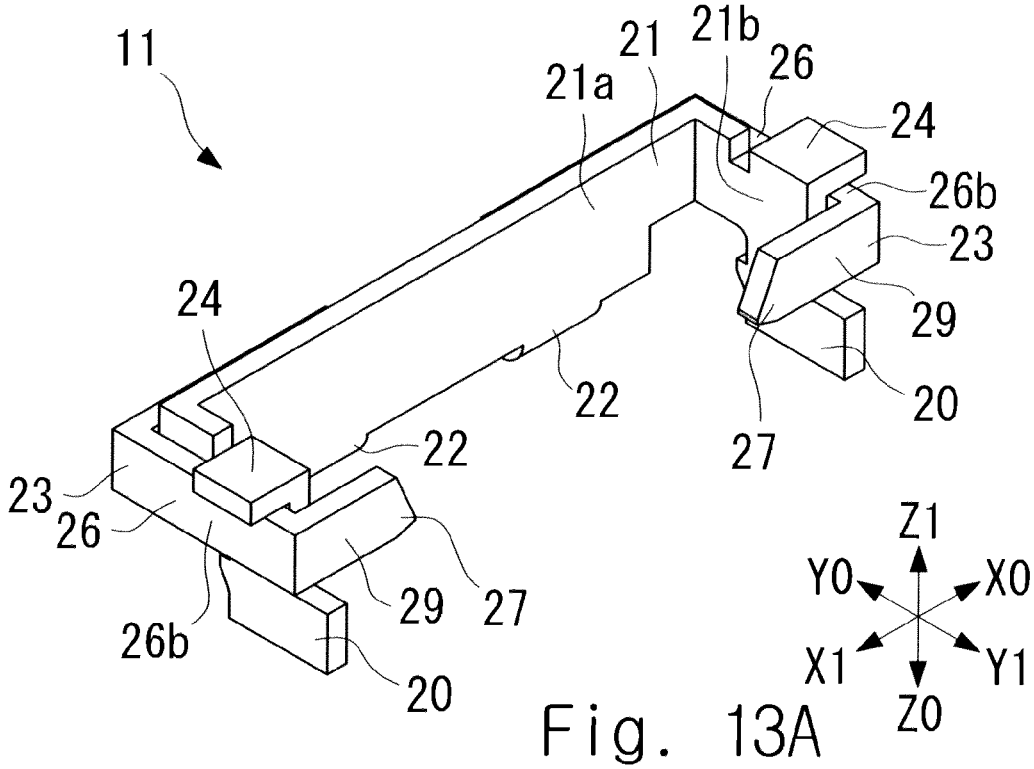
FIG. 13A is a perspective view of a receptacle assistant fitting according to a second exemplary embodiment seen from a coupling side.
Figure 13B:
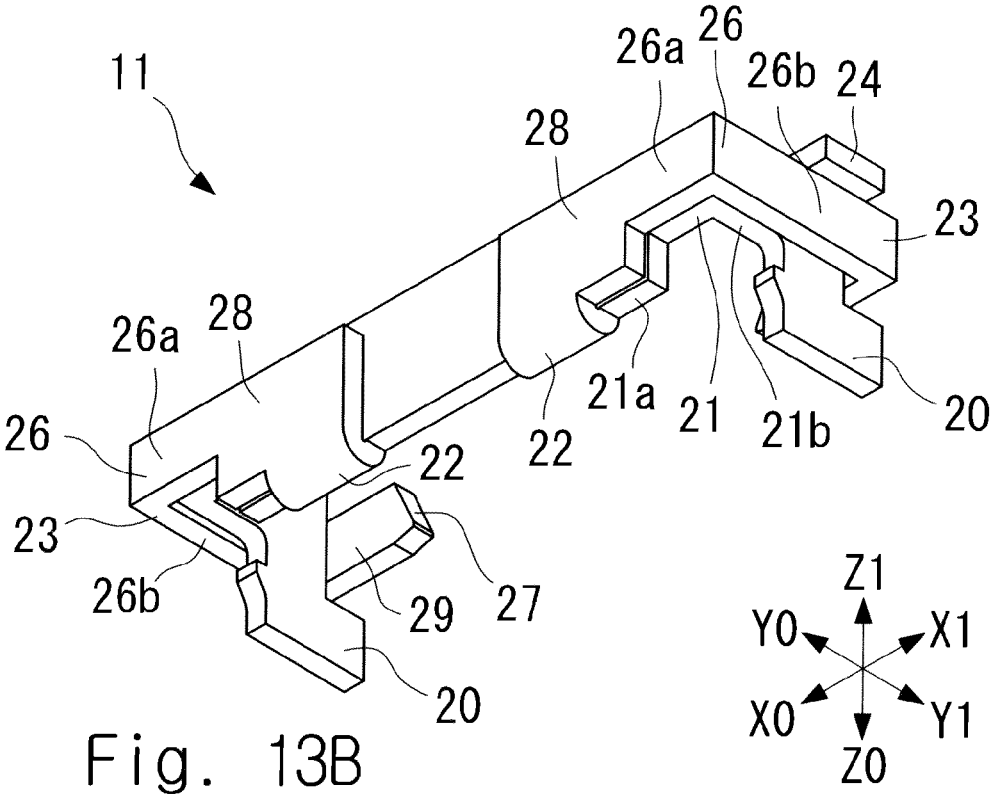
FIG. 13B is a perspective view of the receptacle assistant fitting according to the second exemplary embodiment seen from a substrate side.

A second exemplary embodiment of the present invention will be described with reference to FIGS. 13A and 13B. In the second exemplary embodiment, differences from the first exemplary embodiment will be mainly described, and the overlapping description will be omitted as appropriate. Further, the components corresponding to those of the first exemplary embodiment are denoted by the same reference symbols.

In the first exemplary embodiment, the displacement regulating parts 24 are adjacent to the coupling parts 29 of the lock beams 23 on the direction Z1 side as shown in FIG. 3A. On the other hand, the displacement regulating parts 24 according to the second exemplary embodiment are formed to extend outwardly from the side surface side lock beam support parts 21*b* so as to be adjacent to the side surface side deflection parts 26*b* on the side of the direction Z1 as shown in FIG. 13A. In this case as well, as shown in FIG. 10B, while the displacement of the free ends 27 of the lock beams 23 in the direction X0 and the direction X1 is allowed, the displacement thereof in the direction Z1 is prohibited.

In the first exemplary embodiment, the lock beam coupling parts 22 couple the rear surface side lock beam support parts 21*a* of the lock beam support part 21 and the fixed ends 28 of the lock beams 23 on the direction Z1 side as shown in FIG. 3B. On the other hand, in the second exemplary embodiment, the lock beam coupling parts 22 couple the rear surface side lock beam support parts 21*a* of the lock beam support part 21 and the fixed ends 28 of the lock beams 23 on the direction Z0 side as shown in FIG. 13B.

Third Exemplary Embodiment

Figure 14A:
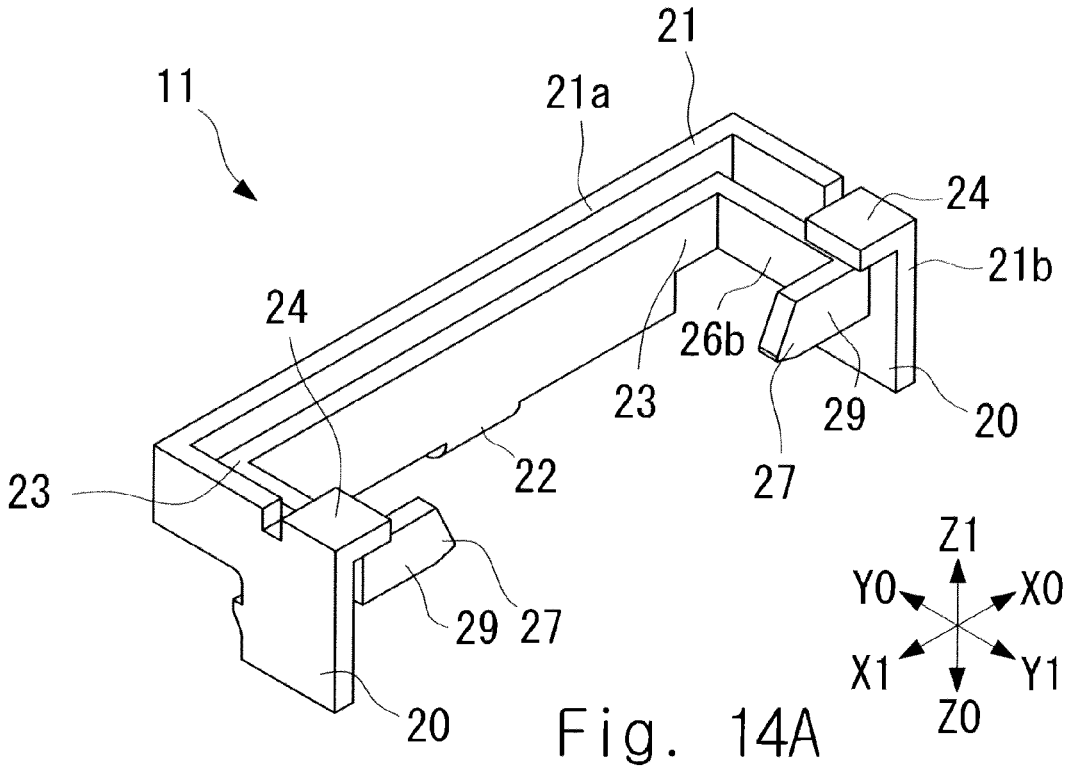
FIG. 14A is a perspective view of a receptacle assistant fitting according to a third exemplary embodiment seen from a coupling side.
Figure 14B:
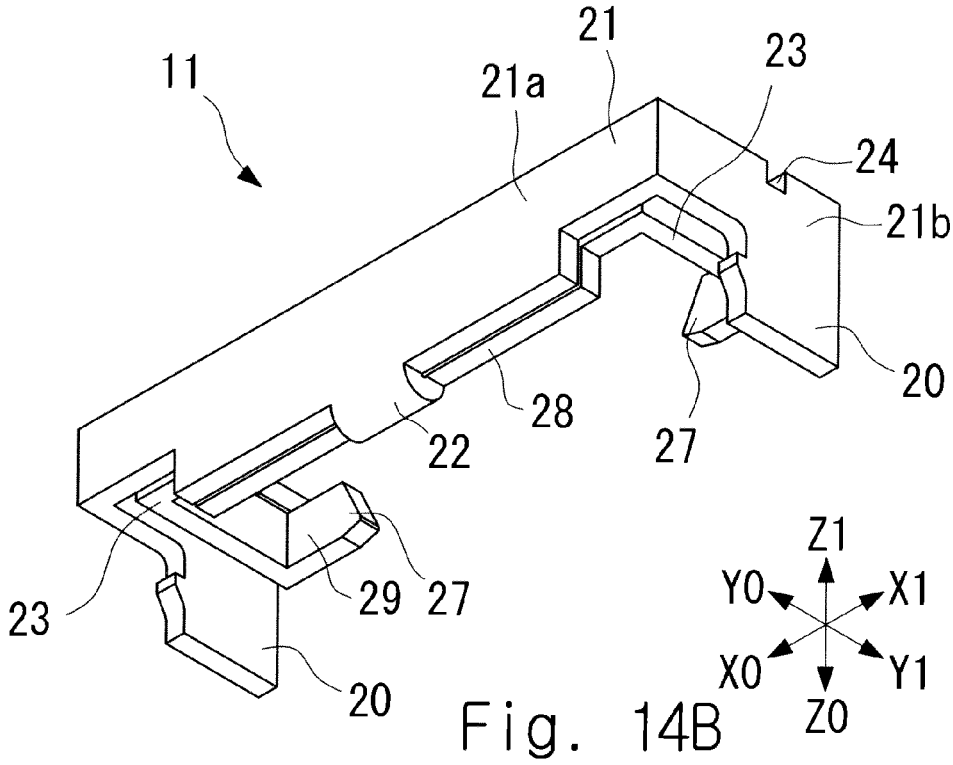
FIG. 14B is a perspective view of the receptacle assistant fitting according to the third exemplary embodiment seen from a substrate side.

Next, a third exemplary embodiment of the present invention will be described with reference to FIGS. 14A and 14B. In the third exemplary embodiment, differences from the first exemplary embodiment will be mainly described, and the overlapping description will be omitted as appropriate. Further, the components corresponding to those of the first exemplary embodiment are denoted by the same reference symbols.

In the first exemplary embodiment, the lock beam support part 21 is formed along with the lock beams 23 inside the lock beams 23 as shown in FIG. 3A. On the other hand, the lock beam support part 21 according to the third exemplary embodiment is formed along with the lock beams 23 outside the lock beams 23 as shown in FIG. 14B.

In the first exemplary embodiment, the displacement regulating parts 24 are adjacent to the coupling parts 29 of the lock beams 23 on the side of the direction Z1 as shown in FIG. 3A. On the other hand, the displacement regulating parts 24 according to the third exemplary embodiment are formed to extend inwardly from the side surface side lock beam support parts 21*b* so as to be adjacent to the side surface side deflection parts 26*b* on the side of the direction Z1 as shown in FIG. 14A. In this case as well, as shown in FIG. 10B, while the displacement of the free ends 27 of the lock beams 23 in the direction X0 and the direction X1 is allowed, the displacement thereof in the direction Z1 is prohibited.

Further, in the first exemplary embodiment, as shown in FIG. 3B, the lock beam coupling parts 22 couple the rear surface side lock beam support parts 21*a* of the lock beam support part 21 and the fixed ends 28 of the lock beams 23 on the side of the direction Z1. On the other hand, in the third exemplary embodiment, the lock beam coupling parts 22 couple the rear surface side lock beam support parts 21*a* of the lock beam support part 21 and the fixed ends 28 of the lock beams 23 on the direction Z0 side as shown in FIG. 14B.

Fourth Exemplary Embodiment

Next, a fourth exemplary embodiment of the present invention will be described with reference to FIG. 15. In the fourth exemplary embodiment, differences from the first exemplary embodiment will be mainly described, and the overlapping description will be omitted as appropriate. Further, the components corresponding to those of the first exemplary embodiment are denoted by the same reference symbols.

In the first exemplary embodiment, the plug assistant fitting 8 and the free ends 27 of the lock beams 23 are contacted with each other as shown in FIG. 9B when the plug connector 4 and the receptacle connector 5 are coupled to each other. On the other hand, in the fourth exemplary embodiment, when the plug connector 4 and the receptacle connector 5 are coupled to each other, the plug assistant fitting 8 and the free ends 27 of the lock beams 23 do not contact with each other as shown in FIG. 15. In this case as well, however, the free ends 27 of the lock beams 23 and the engagement parts 32 of the plug assistant fitting 8 are opposed with each other in the direction Z1; in this sense, it can be considered that the engagement parts 32 of the plug assistant fitting 8 engages with the free ends 27 of the lock beams 23.

Fifth Exemplary Embodiment

Now, a fifth exemplary embodiment of the present invention will be described with reference to FIG. 16. In the fifth exemplary embodiment, differences from the first exemplary embodiment will be mainly described, and the overlapping description will be omitted as appropriate. Further, the components corresponding to those of the first exemplary embodiment are denoted by the same reference symbols.

The free ends 27 of the lock beams 23 of the first exemplary embodiment include the lower-side inclined surfaces 31 whose normal direction is close to the direction Z0 formed therein as shown in FIG. 4. Thus, as shown in FIG. 10B, when the engagement parts 32 contact with the free ends 27 in the direction Z1, the free ends 27 withdraw in the direction X0 and the direction X1, as shown in FIG. 11B, thereby allowing the engagement parts 32 to ride over the free ends 27. In contrast, the free ends 27 of the lock beams 23 according to the fifth exemplary embodiment do not include the lower-side inclined surfaces 31, but include lower engagement surfaces 27*a* perpendicular to the direction Z1 formed therein as shown in FIG. 16, in place of the lower-side inclined surfaces 31. When the plug connector 4 is coupled to the receptacle connector 5, the lower engagement surfaces 27*a* of the free ends 27 and the upper engagement surfaces 33 of the engagement parts 32 are opposed to each other in the direction Z1. Both of the lower engagement surface 27*a* of the free ends 27 and the upper engagement surfaces 33 of the engagement parts 32 are perpendicular to the direction Z1. Thus, even when the engagement parts 32 contact with the free ends 27 in the direction Z1, the free ends 27 do not withdraw in the directions X0 and X1, and the engagement parts 32 cannot ride over the free ends 27. As stated above, the lower engagement surfaces 27*a* of the free ends 27 and the upper engagement surfaces 33 of the engagement parts 32 achieve the structure of a so-called fixed-fitting.

Sixth Exemplary Embodiment

A sixth exemplary embodiment of the present invention will now be described with reference to FIGS. 17A to 19B. In the sixth exemplary embodiment, differences from the fifth exemplary embodiment will be mainly described, and the overlapping description will be omitted as appropriate. Further, the components corresponding to those of the fifth exemplary embodiment are denoted by the same reference symbols.

Figure 17A:
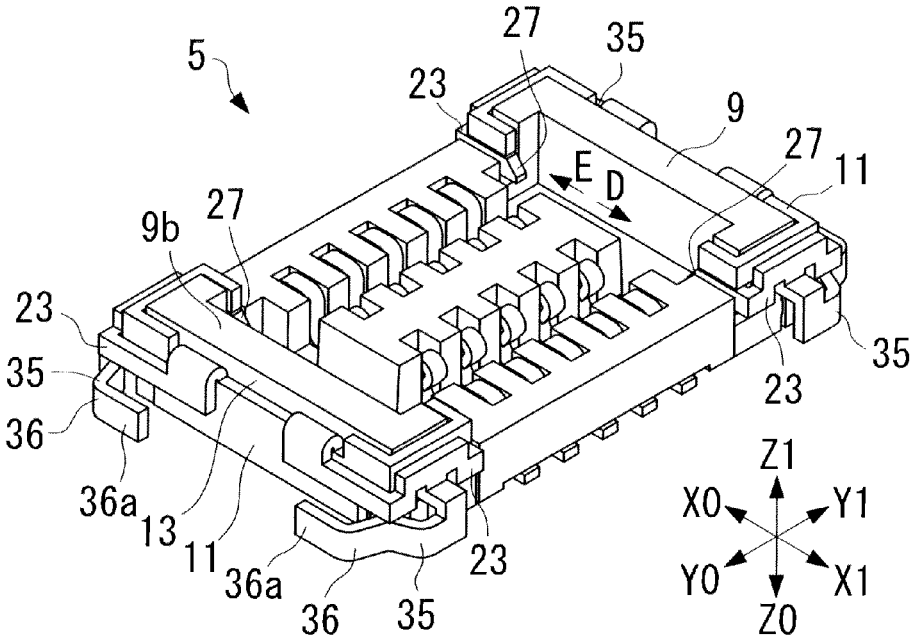
FIG. 17A is a perspective view of a receptacle connector according to a sixth exemplary embodiment seen from a coupling side.
Figure 17B:
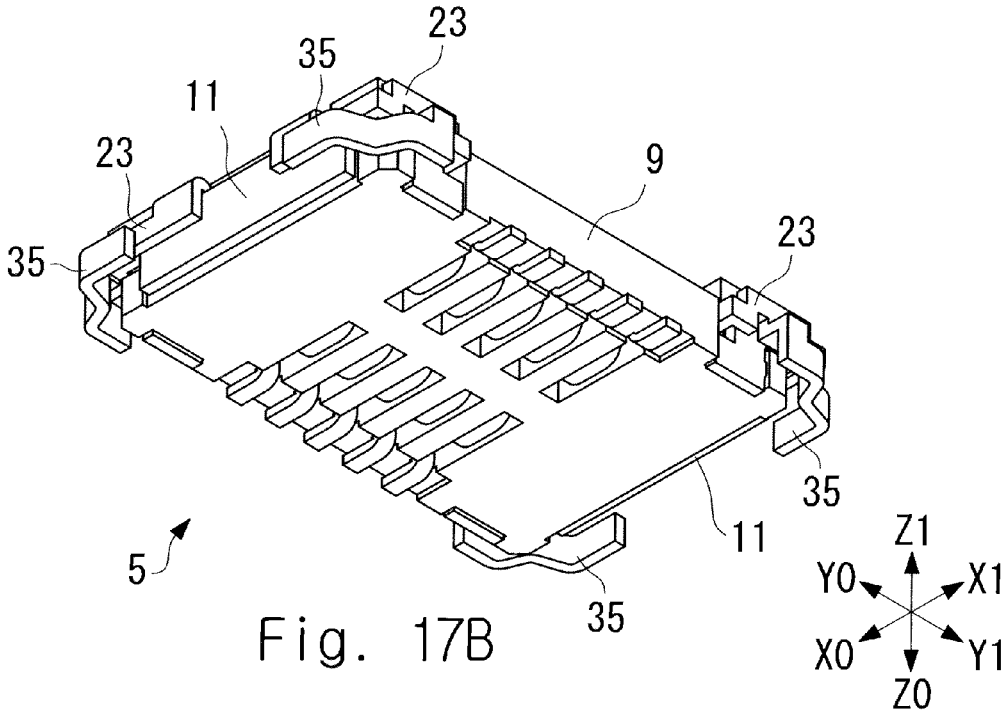
FIG. 17B is a perspective view of the receptacle connector according to the sixth exemplary embodiment seen from a substrate side.
Figure 18A:
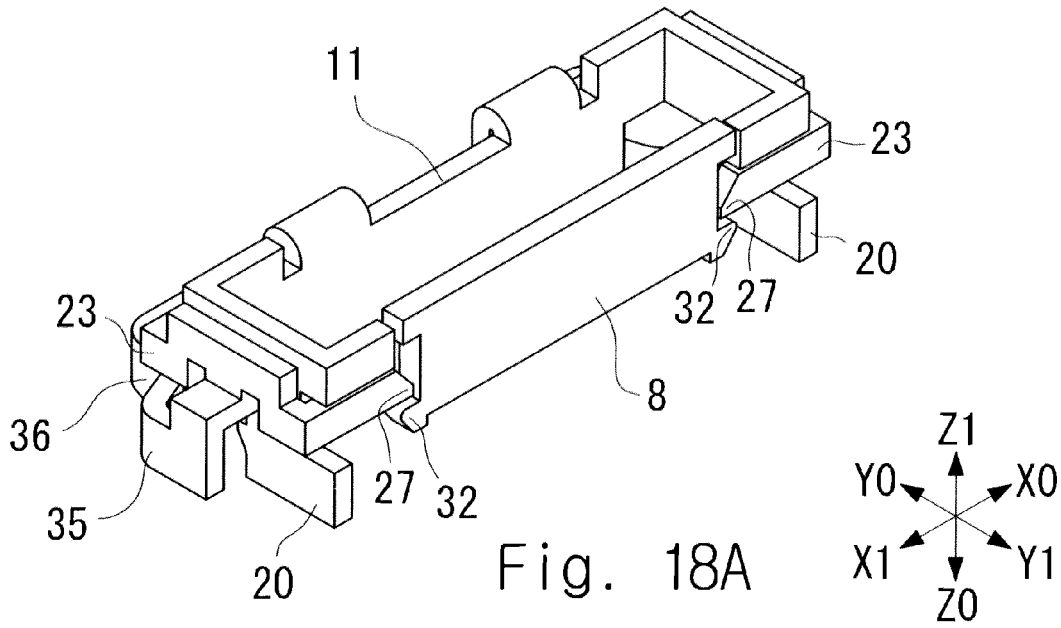
FIGS. 18A and 18B are perspective views showing a state in which a plug assistant fitting and a receptacle assistant fitting are engaged with each other seen from a coupling side.
Figure 18B:
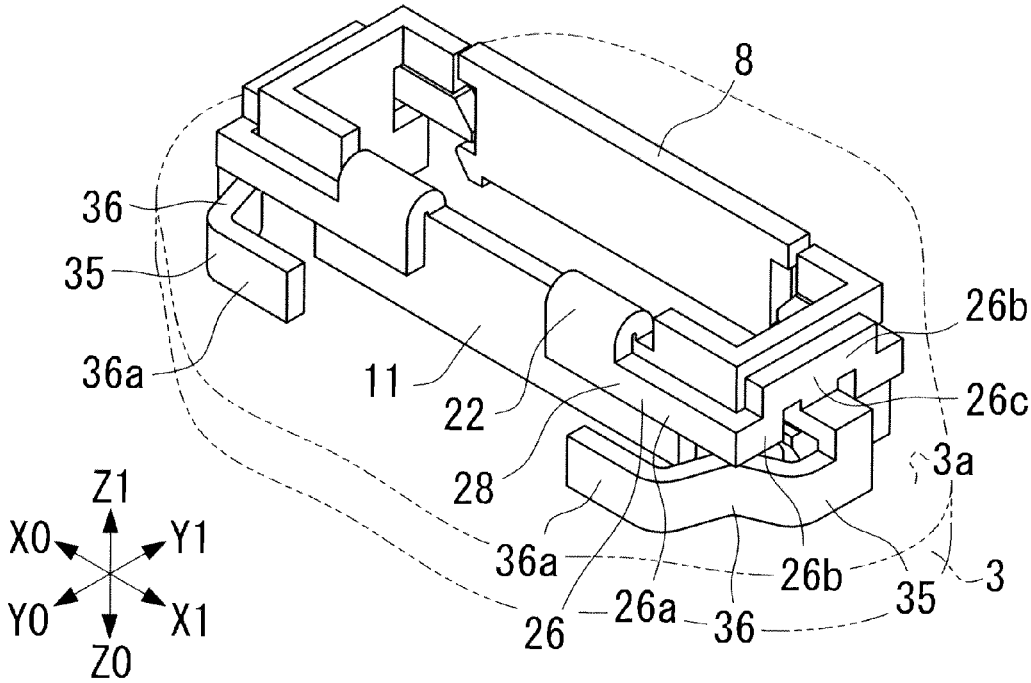

In the sixth exemplary embodiment, the receptacle assistant fitting 11 includes, as shown in FIGS. 17A and 17B, an unlocking mechanism 35 that allows the free end 27 of the lock beam 23 projecting in the receptacle housing 9 to withdraw in the direction E which is opposite to the projecting direction D. The unlocking mechanism 35 includes a cantilevered torque generation beam 36 (torque generation means) as shown in FIGS. 18A and 18B. This torque generation beam 36 connects with a longitudinal direction middle part 26*c* of the side surface side deflection part 26*b* of the deflection part 26 of the lock beam 23 and extends in a direction substantially parallel to the connector mounting surface 3*a* of the receptacle side substrate 3 shown by an alternate long and two short dashes line as shown in FIG. 18B. More specifically, the torque generation beam 36 contacts with the longitudinal direction middle part 26*c* of the side surface side deflection part 26*b* of the deflection part 26 of the lock beam 23, and extends toward the fixed end 28 of the lock beam 23 approximately in a meander shape. As shown in FIG. 17A, the torque generation beam 36 is formed outside the receptacle housing 9, which means the free end 36*a* of the torque generation beam 36 is also formed outside the receptacle housing 9. As shown in FIG. 17A, the free end 36*a* of the torque generation beam 36 is opposed to the rear surface 13 of the receptacle assistant fitting holding wall 9*b* of the receptacle housing 9.

Figure 19A:
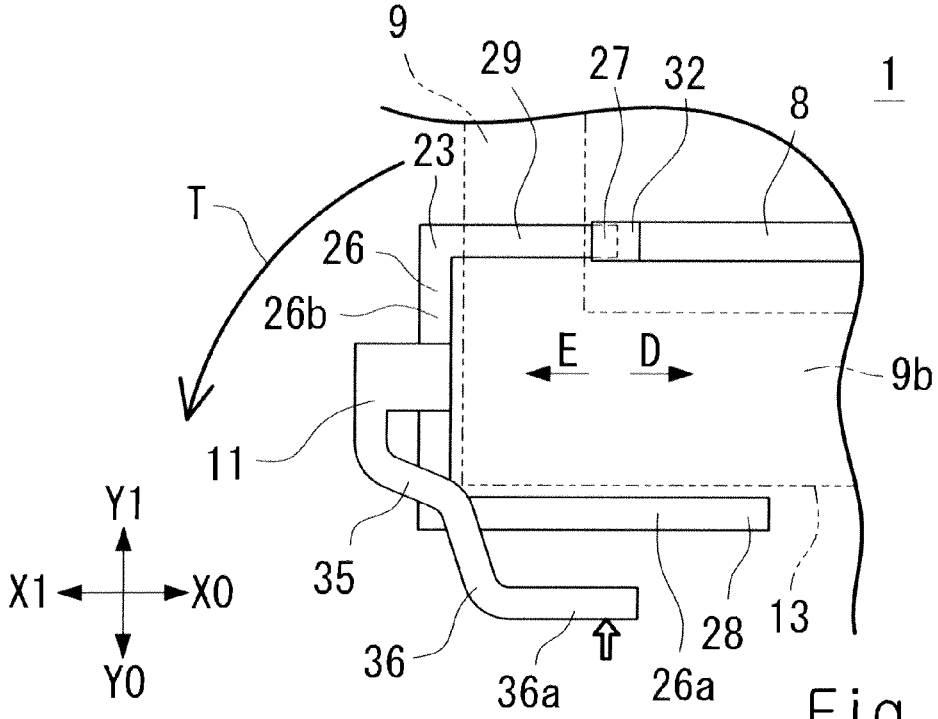
FIGS. 19A and 19B are schematic plane diagrams for explaining an operation mechanism of an unlocking mechanism.
Figure 19B:
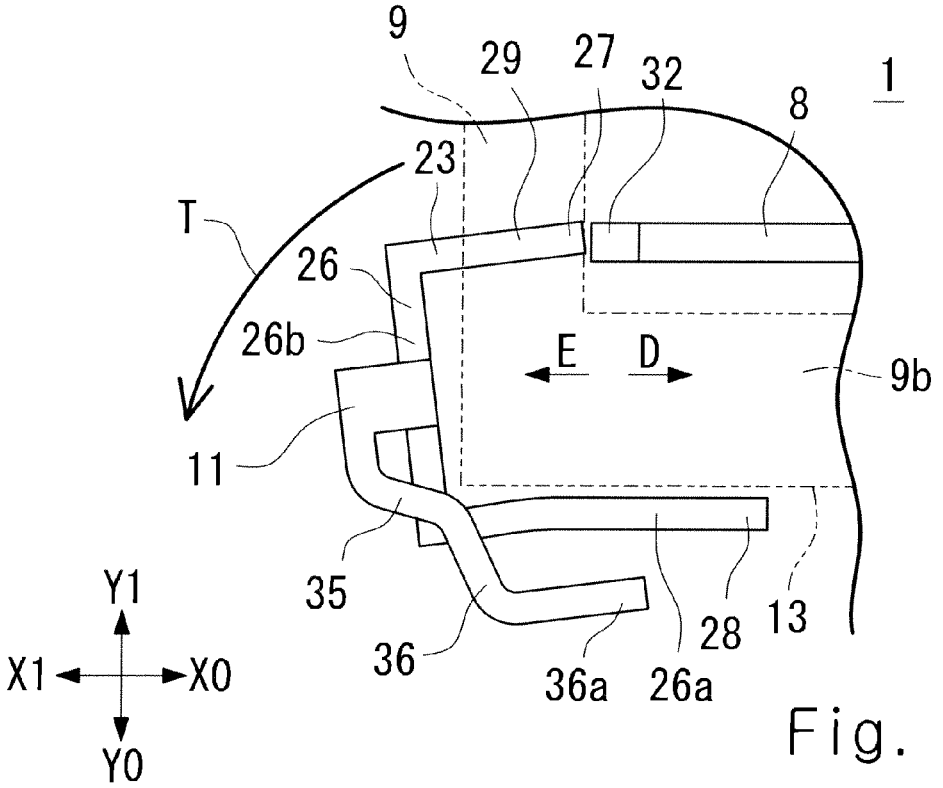

Next, an operation of the unlocking mechanism 35 including the torque generation beam 36 will be described. FIGS. 19A and 19B show the unlocking mechanism 35 seen from a bottom surface. FIG. 19A shows an engagement state in which the free end 27 of the lock beam 23 of the receptacle assistant fitting 11 is engaged with the engagement part 32 of the plug assistant fitting 8. FIG. 19B shows an unlocking state by the unlocking mechanism 35.

When the free end 36*a* of the torque generation beam 36 is pressed toward the rear surface 13 of the receptacle assistant fitting holding wall 9*b* of the receptacle housing 9 as shown in an outline arrow with the engagement state in FIG. 19A, torque T is generated in the lock beams 23. On the other hand, since the lock beam 23 is supported by the receptacle assistant fitting 11 at the fixed end 28, the lock beam 23 is elastically deformed so that the free end 27 of the lock beam 23 projecting inside the receptacle housing 9 is withdrawn in the direction E opposite to the projecting direction D with the neighborhood of the fixed end 28 as a center as shown in FIG. 19B. As a result, an engagement state in which the free end 27 of the lock beam 23 of the receptacle assistant fitting 11 overlaps with the engagement part 32 of the plug assistant fitting 8 seen from a bottom surface as shown in FIG. 19A transits to an unlocking state in which the free end 27 of the lock beam 23 of the receptacle assistant fitting 11 does not overlap with the engagement part 32 of the plug assistant fitting 8 seen from a bottom surface as shown in FIG. 19B. As shown in FIG. 19B, if the state of the connector 1 is switched from the engagement state to the unlocking state, the plug connector 4 can be decoupled from the receptacle connector 5 with a smaller strength.

(Summary)

As described above, in the sixth exemplary embodiment, as shown in FIGS. 17A and 17B, the unlocking mechanism 35 that allows the free end 27 of the lock beam 23 projecting into the receptacle housing 9 to withdraw in the direction E opposite to the projecting direction D is provided. According to the configuration stated above, the engagement of the engagement parts 32 of the plug assistant fitting 8 and the free ends 27 of the lock beams 23 can be forcibly cancelled, thereby reducing the force required to decouple the plug connector 4 and the receptacle connector 5.

As shown in FIGS. 18A and 18B, the unlocking mechanism 35 includes the torque generation beam 36 (torque generation means) that generates torque T for the lock beam 23 to withdraw the free end 27 of the lock beam 23 projecting inside the receptacle housing 9 in the direction E opposite to the projection direction D. According to the configuration stated above, the unlocking mechanism 35 is obtained by the simple mechanism.

Furthermore, as shown in FIG. 18B, the torque generation beam 36 has a cantilevered shape connected to the longitudinal direction middle part 26*c* of the lock beam 23 and extending in the direction substantially parallel to the connector mounting surface 3*a* of the receptacle side substrate 3. Operating the free end 36*a* of the torque generation beam 36 with the configuration stated above generates torque T that withdraws the free end 27 of the lock beam 23 projecting inside the receptacle housing 9 in the direction E opposite to the projecting direction D. In this manner, according to the configuration stated above, the torque T can be generated with the simple configuration.

Further, as shown in FIG. 17A, the free end 36*a* of the torque generation beam 36 is formed in the outside of the receptacle housing 9. According to the structure described above, operability of the free end 36*a* of the torque generation beam 36 can be improved.

Seventh Exemplary Embodiment

Next, a seventh exemplary embodiment of the present invention will be described with reference to FIGS. 20 and 21. In the seventh exemplary embodiment, differences from the first exemplary embodiment will be mainly described, and the overlapping description will be omitted as appropriate. Further, the components corresponding to those of the first exemplary embodiment are denoted by the same reference symbols.

In the first exemplary embodiment, as shown in FIG. 3A, the displacement regulating parts 24 are adjacent to the coupling parts 29 of the lock beams 23 on the side of the direction Z1. On the other hand, as shown in FIGS. 20 and 21, the displacement regulating parts 24 according to the seventh exemplary embodiment are adjacent to the coupling parts 29 of the lock beams 23 on the side of the direction Z0.

Figure 20:
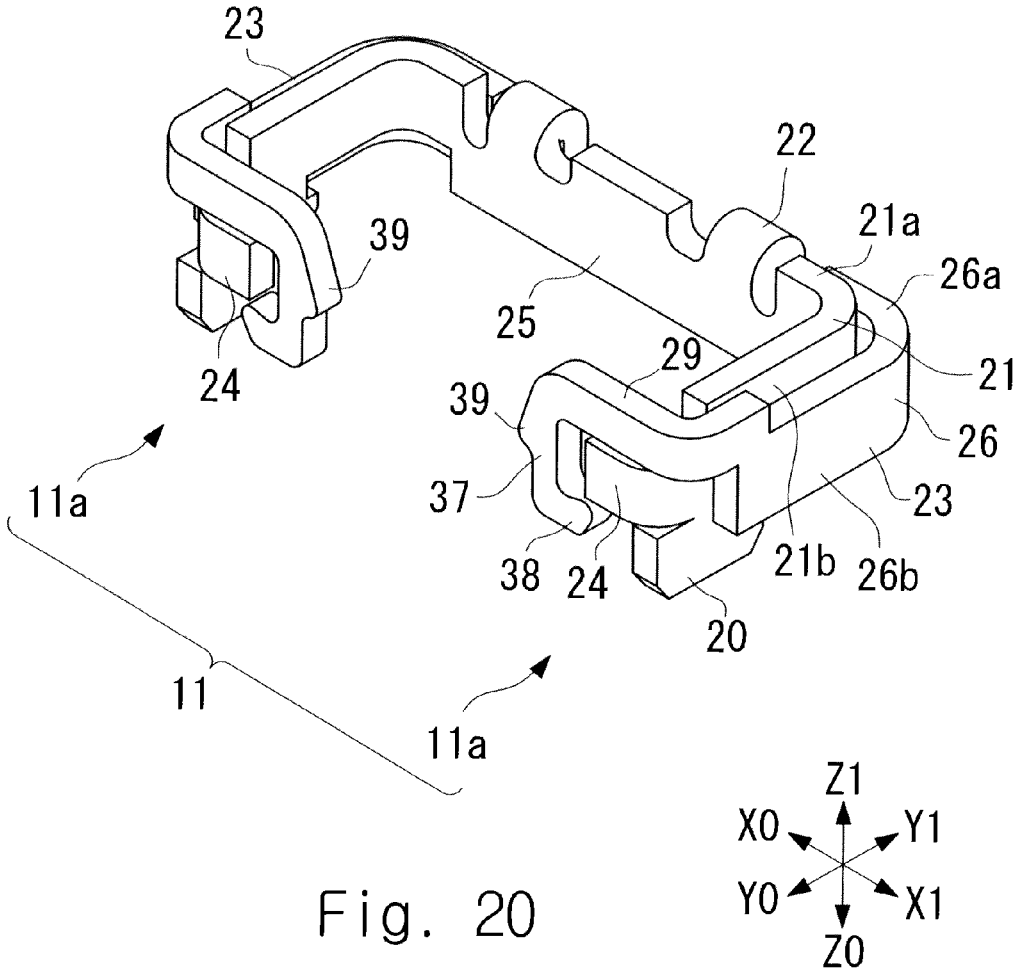
FIG. 20 is a perspective view of a receptacle assistant fitting according to a seventh exemplary embodiment seen from a coupling side.
Figure 21:
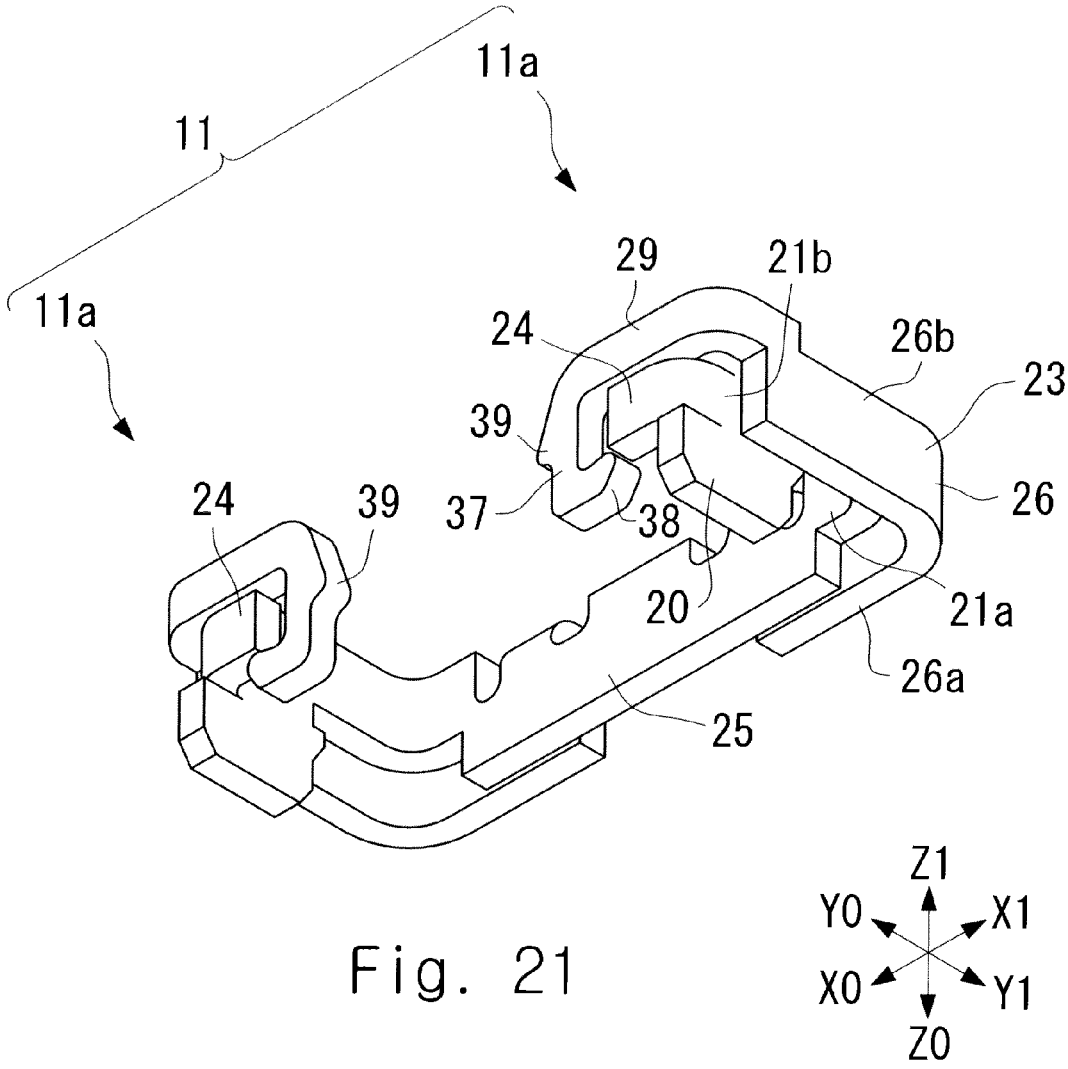
FIG. 21 is a perspective view of the receptacle assistant fitting seen from a substrate side.

Furthermore, in the seventh exemplary embodiment, as shown in FIGS. 20 and 21, a vertical part 37 which extends in the direction Z0 (toward the connector mounting surface 3*a* of the receptacle side substrate 3) is formed at the end of the connecting part 29 of the lock beam 23. Further, a first engagement projection 38 that projects in the opposite side from the coupling part 29 with the displacement regulating parts 24 interposed therebetween is formed at the end of the vertical part 37. A second engagement projection 39 corresponding to the free end 27 in the first exemplary embodiment is formed in the middle part of the longitudinal direction of the vertical part 37. In summary, in the seventh exemplary embodiment, the lock beam 23 mainly includes the deflection part 26, the coupling part 29, the vertical part 37, the first engagement projection 38, and the second engagement projection 39.

(Operation when Connector 1 is Coupled)

When the connector 1 is coupled, the engagement parts 32 of the plug assistant fitting 8 of the plug connector 4 push aside the second engagement projections 39 of the lock beams 23 and ride over the second engagement projections 39 of the lock beams 23 to be engaged with the second engagement projections 39 of the lock beams 23 when the plug connector 4 and the receptacle connector 5 are coupled.

(Operation when Connector 1 is Decoupled)

Meanwhile, when the connector 1 is decoupled, the plug housing 6 of the plug connector 4 is pulled up in the direction Z1. Then, the engagement parts 32 of the plug assistant fitting 8 contact with the second engagement projections 39 of the lock beams 23, and the engagement parts 32 tend to push up the second engagement projections 39. However, the displacement regulating parts 24 which are strongly fixed to the connector mounting surface 3*a* of the receptacle side substrate 3 by the substrate ground parts 20 are adjacent to the first engagement projections 38 on the side of the direction Z1. Thus, the engagement parts 32 are prevented from pushing up the second engagement projections 39.

Eighth Exemplary Embodiment

Next, an eighth exemplary embodiment of the present invention will be described with reference to FIGS. 22 to 29. In the eighth exemplary embodiment, differences from the first exemplary embodiment will be mainly described, and the overlapping description will be omitted as appropriate. Further, the components corresponding to those of the first exemplary embodiment are denoted by the same reference symbols.

(Receptacle Housing 9)

Figure 22:
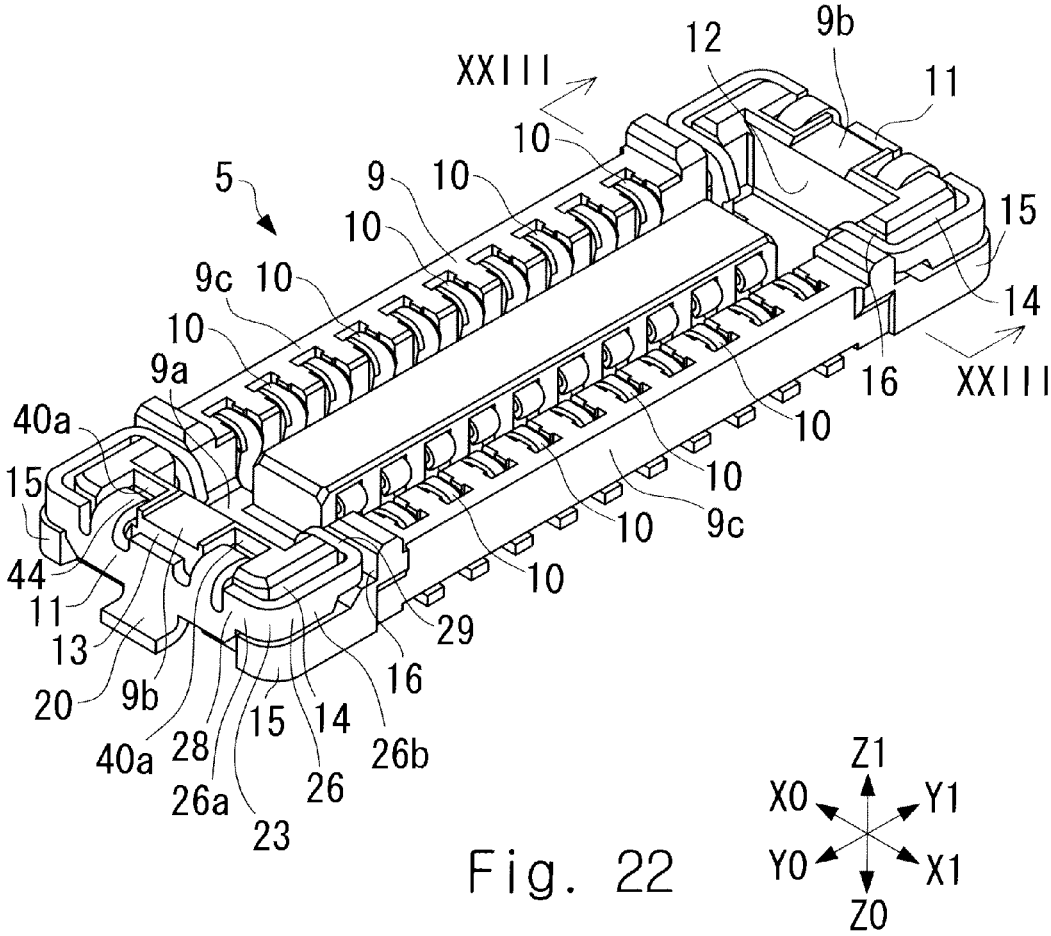
FIG. 22 is a perspective view of a receptacle connector according to an eighth exemplary embodiment.

As shown in FIG. 22, each of the receptacle assistant fitting holding walls 9*b* include the corner part 15 in the lower neighborhood of each of the pair of the side surfaces 14. The lock groove 16 penetrating in the directions X0 and X1 is formed between the receptacle assistant fitting holding wall 9*b* and the receptacle contact holding walls 9*c*. Further, two fitting attachment holes 40*a* are formed on an upper surface 40 of each of the receptacle assistant fitting holding walls 9*b*.

Figure 23:
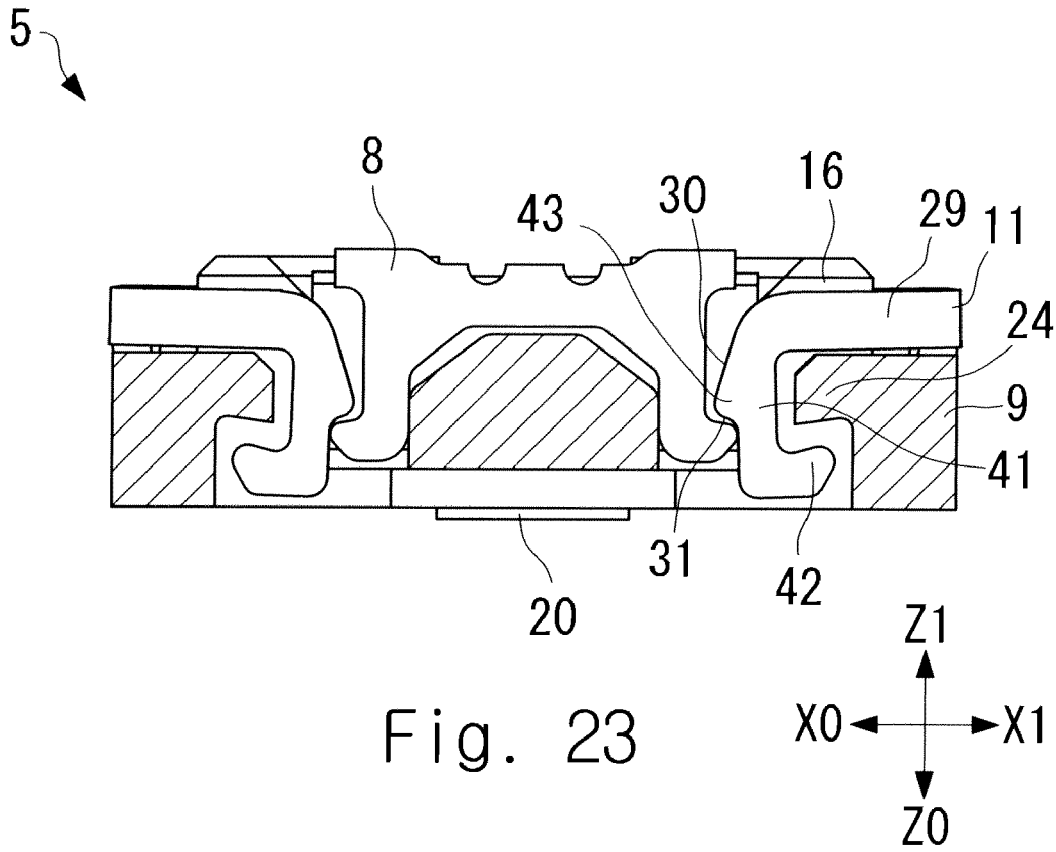
FIG. 23 is a cross-sectional view taken along the line XXIII-XXIII of FIG. 22.

As shown in FIG. 23, in the receptacle housing 9, the displacement regulating parts 24 that project inside the receptacle housing 9 are formed in the middle of the connector 1 in the height direction.

The receptacle assistant fitting 11 and the plug assistant fitting 8 will be described with reference to FIGS. 23 to 27. FIG. 23 shows a state in which the connector 1 is connected.

(Receptacle Assistant Fitting 11)

Figure 25:
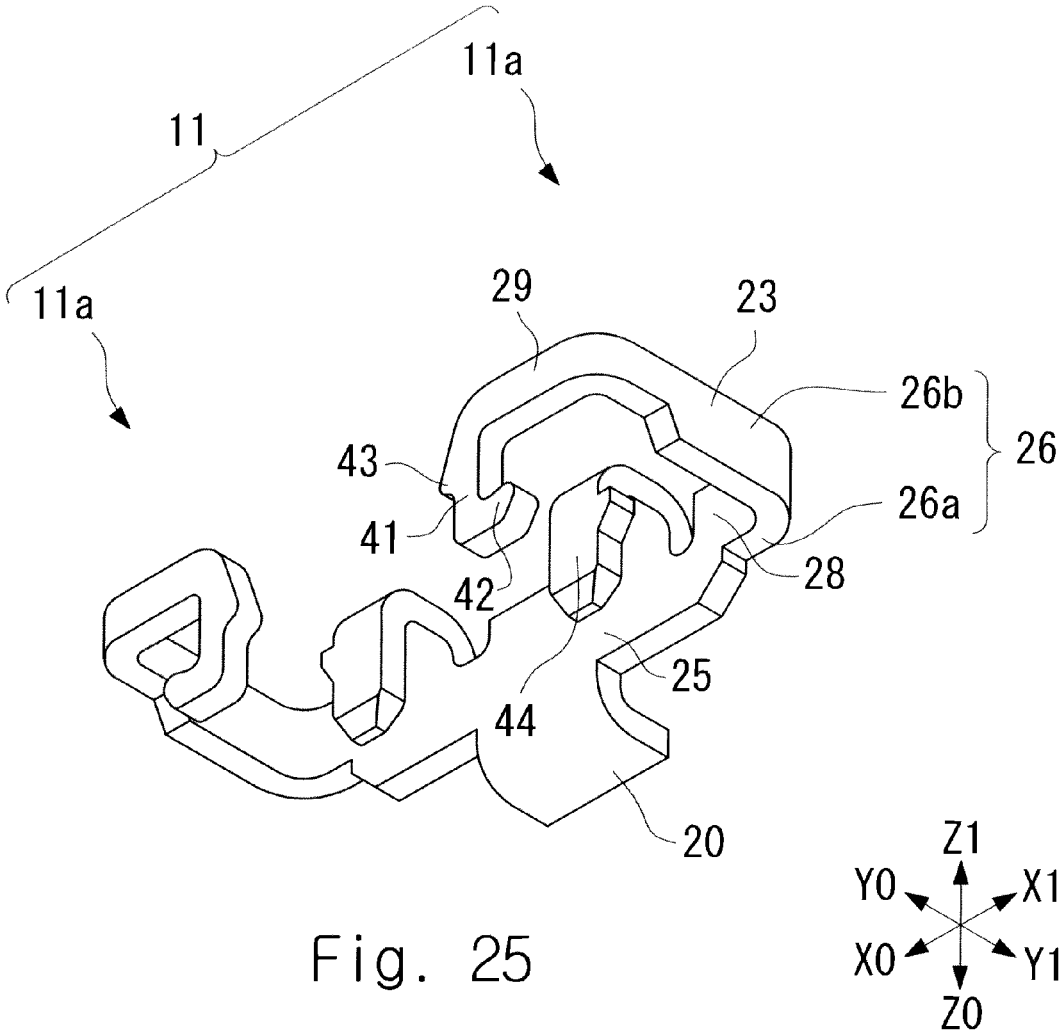
FIG. 25 is a perspective view of the receptacle assistant fitting seen from a substrate side.

The receptacle assistant fitting 11 is formed, as shown in FIGS. 24 and 25, by folding a plate obtained by stamping a metal thin plate in a certain shape at a certain position. Since the receptacle assistant fitting 11 is line-symmetrical in the directions X0 and X1 as shown in FIG. 24 and so on, description will now be made of the receptacle assistant fitting part 11*a* obtained by dividing the receptacle assistant fitting 11 in two in the directions X0 and X1.

The receptacle assistant fitting part 11*a* mainly includes the substrate ground part 20, the lock beam 23, the stabilizer 25, and a fitting fixing piece 44.

The lock beam 23 is, as shown in FIG. 22, a cantilever having the deflection part 26 extending in the direction parallel to the connector mounting surface 3*a* of the receptacle side substrate 3 on the outside of the receptacle housing 9 (see also FIG. 1). The lock beam 23 includes the deflection part 26, the coupling part 29, a vertical part 41, a first engagement projection 42, and a second engagement projection 43. The deflection part 26 is composed of the rear surface side deflection part 26*a* that extends toward the side surface 14 side along the rear surface 13 from the fixed end 28 which is located at a certain position of the rear surface 13 of the receptacle assistant fitting holding wall 9*b* of the receptacle housing 9, and the side surface side deflection part 26*b* that extends toward the receptacle contact holding wall 9*c* side along the side surface 14 from the end of the rear surface side deflection part 26*a* as shown in FIG. 22. As shown in FIG. 22, the coupling part 29 is connected to the end of the side surface side deflection part 26*b*, penetrates through the lock groove 16 of the receptacle housing 9, and reaches the receptacle housing 9. As shown in FIG. 23, the vertical part 41 connects to the end of the coupling part 29, and extends toward the connector mounting surface 3*a* of the receptacle side substrate 3 in the receptacle housing 9 in a direction that is perpendicular to the connector mounting surface 3*a* of the receptacle side substrate 3 (see also FIG. 1). In the end of the vertical part 41, the first engagement projection 42 that projects in the opposite side from the coupling part 29 with the displacement regulating part 24 of the receptacle housing 9 interposed therebetween is formed. The second engagement projection 43 corresponding to the free ends 27 in the first exemplary embodiment is formed in the middle of the longitudinal direction of the vertical part 41. The second engagement projection 43 includes an upper-side inclined surface 30 and a lower-side inclined surface 31.

The substrate ground part 20 shown in FIG. 22 is soldered to the connector mounting surface 3*a* of the receptacle side substrate 3 shown in FIG. 1B. In the eighth exemplary embodiment, the receptacle assistant fitting 11 includes one substrate ground part 20.

As shown in FIG. 25, the lock beam 23 is indirectly supported by the substrate ground part 20 through the stabilizer 25.

The fitting fixing piece 44 is, as shown in FIG. 22, pressed into the fitting attachment hole 40*a* formed in the receptacle assistant fitting holding wall 9*b* of the receptacle housing 9.

(Plug Assistant Fitting 8)

Figure 26:
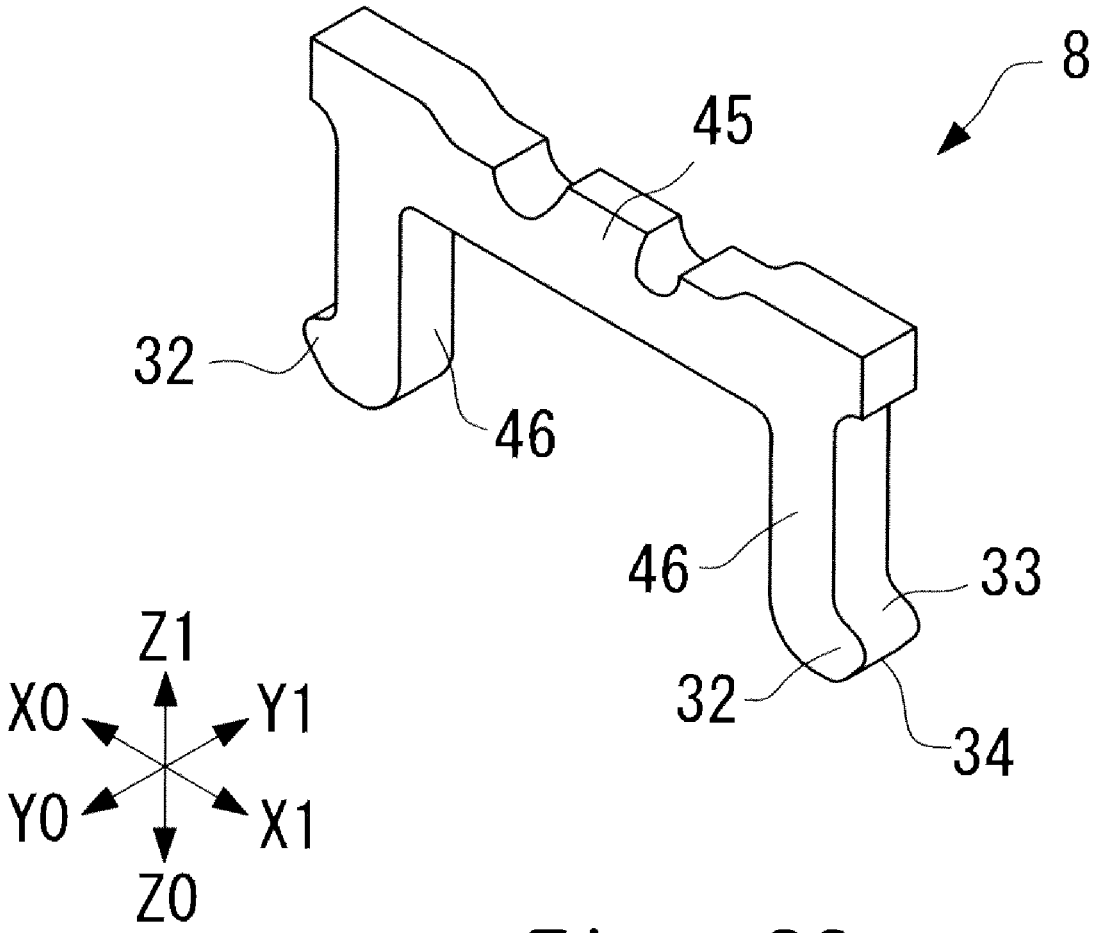
FIG. 26 is a perspective view of a plug assistant fitting of a plug connector.
Figure 27:
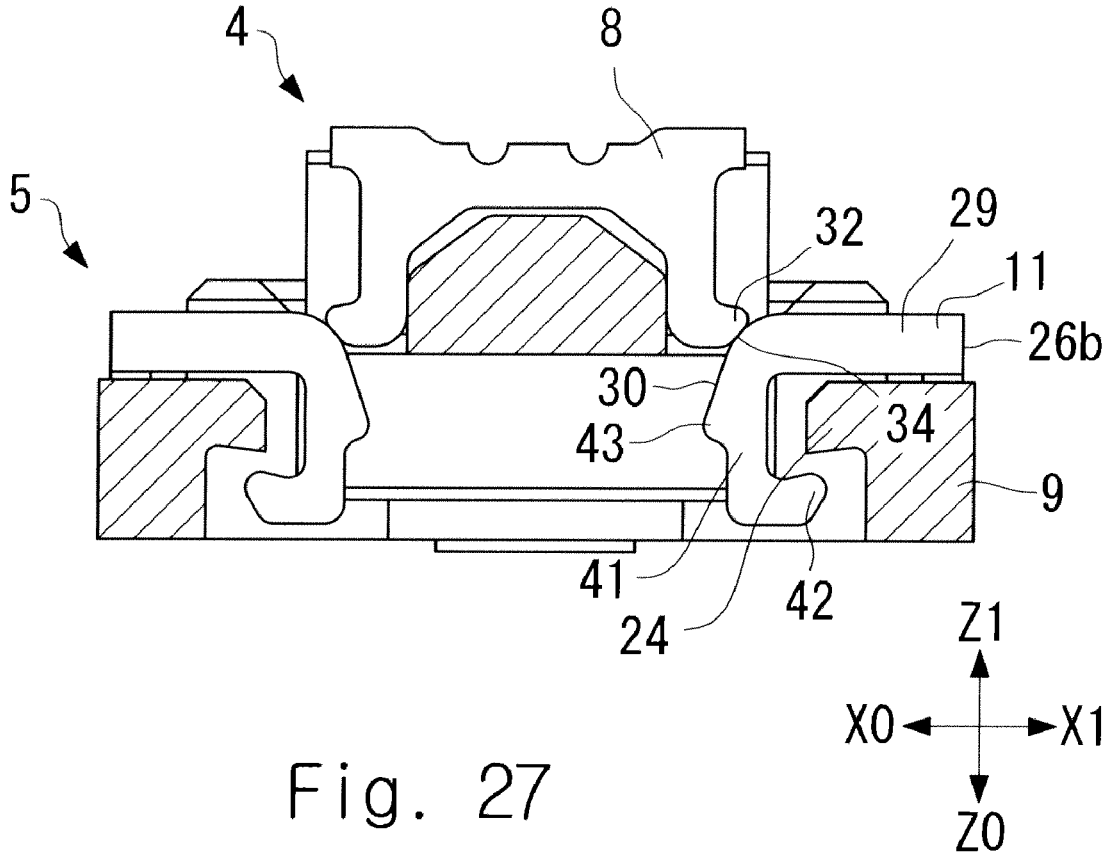
FIG. 27 is an operation diagram explaining coupling of a connector.
Figure 28:
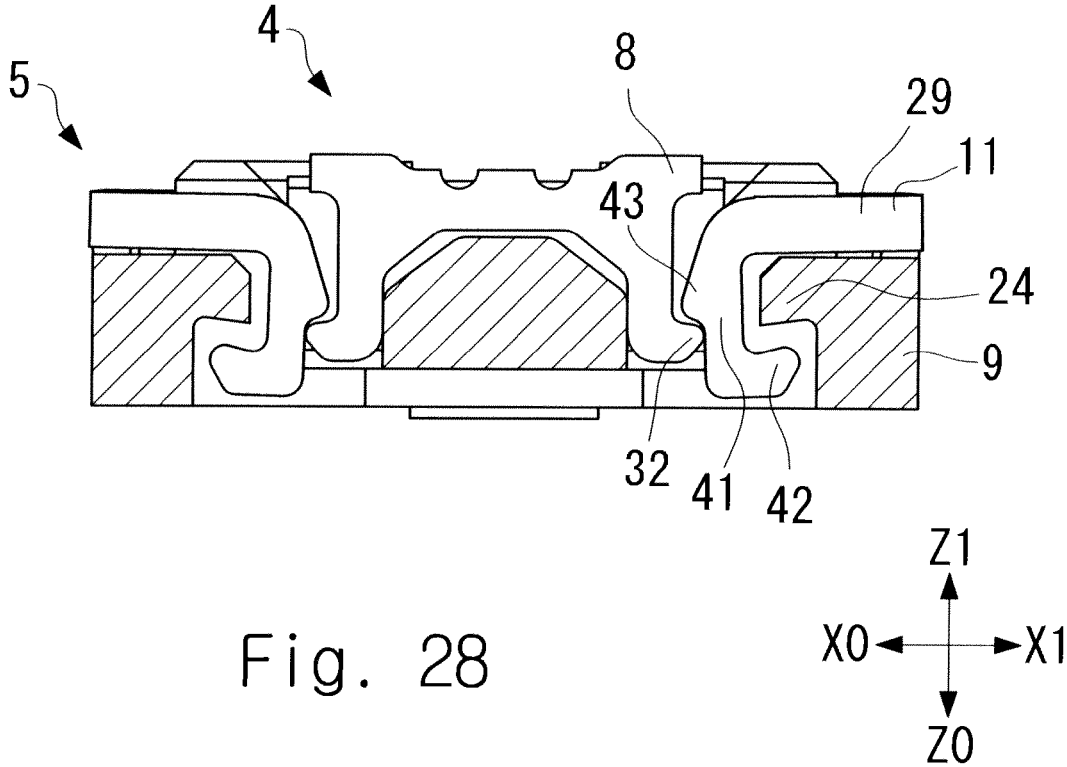
FIG. 28 is an operation diagram explaining the coupling of the connector.

The plug assistant fitting 8 is obtained by stamping a metal thin plate in a certain shape as shown in FIG. 26. The plug assistant fitting 8 has substantially an inverted U-shape, and includes a base part 45 extending in the direction parallel to the connector mounting surface 2*a* of the plug side substrate 2 (see also FIG. 2A), and a pair of leg parts 46 connected to both ends of the base part 45 and extending in a direction perpendicular to the longitudinal direction of the base part 45. Each of the leg parts 46 includes the engagement part 32 formed in its end. Each of the engagement parts 32 includes the upper engagement surface 33 and the lower-side inclined surface 34. Each of the engagement parts 32 pushes aside the second engagement projection 43 of the vertical part 41 of the lock beams 23 and rides over the second engagement projection 43, so as to be engaged with the second engagement projection 43 when the plug connector 4 and the receptacle connector 5 are coupled to each other, as shown in FIGS. 27 and 28.

(Operation when Connector 1 is Coupled)

Next, an operation when the connector 1 is coupled will be described with reference to FIGS. 27 and 28. First, when the plug housing 6 is inserted into the receptacle housing 9 in the direction shown in FIGS. 1A and 1B, because of the positioning action by the plug housing 6 and the receptacle housing 9, the engagement parts 32 of the plug assistant fitting 8 and the second engagement projections 43 of the vertical parts 41 of the lock beams 23 of the receptacle assistant fitting 11 are opposed to each other in the direction Z1 and direction Z0, and are contacted as shown in FIG. 27. Specifically, the lower-side inclined surfaces 34 of the engagement parts 32 of the plug assistant fitting 8 of the plug connector 4 and the upper-side inclined surfaces 30 of the second engagement projections 43 of the vertical parts 41 of the lock beams 23 of the receptacle assistant fitting 11 of the receptacle connector 5 are contacted.

When the plug housing 6 is further inserted into the receptacle housing 9, the engagement parts 32 of the plug assistant fitting 8 push down the second engagement projections 43 of the vertical parts 41 of the lock beams 23 of the receptacle assistant fitting 11. At this time, slipping is caused between the lower-side inclined surfaces 34 of the engagement parts 32 and the upper-side inclined surfaces 30 of the second engagement projections 43, which causes the coupling parts 29 to be somewhat withdrawn in the directions X1 and X0. To be more specific, since the second engagement projections 43 are pushed down by the engagement parts 32 in a position which is apart from the side surface side deflection parts 26*b* in the direction X1 and direction X0, torsion is occurred in the side surface side deflection parts 26*b*.

When the plug housing 6 is further inserted into the receptacle housing 9, the engagement parts 32 push aside the second engagement projections 43 of the vertical parts 41 of the lock beams 23 and ride over the second engagement projections 43, so as to be engaged with the second engagement projections 43 as shown in FIG. 28. In other words, the engagement parts 32 ride over the second engagement projections 43, and are opposed to the second engagement projections 43 in the direction Z0 and the direction Z1. Hence, the operation when the connector 1 is coupled is completed.

Now, as shown in FIG. 28, in the eighth exemplary embodiment, the vertical parts 41 of the lock beams 23 of the receptacle assistant fitting 11 are somewhat withdrawn in the directions X1 and X0 compared with the state shown in FIG. 27 before the connector 1 is coupled. Specifically, the vertical parts 41 of the lock beams 23 of the receptacle assistant fitting 11 are displaced so as to allow the first engagement projections 42 to be disposed below the displacement regulating parts 24 of the receptacle housing 9. As a result, as shown in FIGS. 27 and 28, an overlapping amount of the first engagement projections 42 of the lock beams 23 of the receptacle assistant fitting 11 and the displacement regulating parts 24 of the receptacle housing 9 in the directions X0 and X1 is increased due to the coupling of the connector 1. Hence, when the receptacle assistant fitting 11 is attached to the receptacle housing 9 before coupling the connector 1, the overlapping amount of the first engagement projections 42 of the lock beams 23 of the receptacle assistant fitting 11 and the displacement regulating parts 24 of the receptacle housing 9 in the directions X0 and X1 needs not be sufficient. The word "sufficient" here means the degree in which, since the first engagement projections 42 of the lock beams 23 of the receptacle assistant fitting 11 physically interferes the displacement regulating parts 24 of the receptacle housing 9, the displacement regulating parts 24 of the receptacle housing 9 can regulate the displacement of the second engagement projections 43 of the vertical parts 41 of the lock beams 23 in the direction Z1. Specifically, the direction in which the first engagement projections 42 are displaced when the plug connector 4 and the receptacle connector 5 are coupled is matched with the direction in which the overlapping amount of the first engagement projections 42 and the displacement regulating parts 24 in the directions X0 and X1 increases, which makes it possible to decrease the overlapping amount of the first engagement projections 42 and the displacement regulating parts 24 in the directions X0 and X1 before coupling the plug connector 4 and the receptacle connector 5, thereby facilitating the attachment of the receptacle assistant fitting 11 to the receptacle housing 9.

(Operation when Connector 1 is Decoupled)

Figure 29:
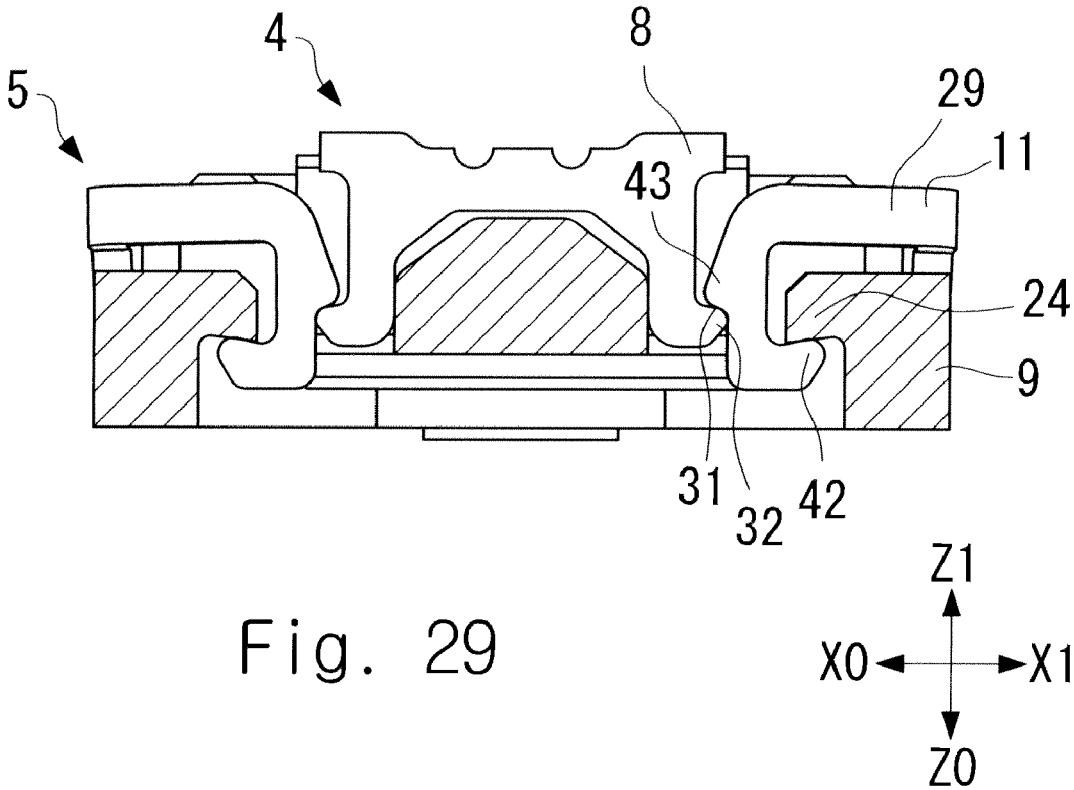
FIG. 29 is an operation diagram explaining decoupling of the connector.

Next, the operation when the connector 1 is decoupled will be described with reference to FIG. 29. First, the plug housing 6 of the plug connector 4 is pulled up in the direction Z1. Then, as shown in FIG. 29, the engagement parts 32 of the plug assistant fitting 8 contact with the lower-side inclined surfaces 31 of the second engagement projections 43 of the vertical parts 41 of the lock beams 23, and the engagement parts 32 tend to push up the second engagement projections 43. However, since the displacement regulating parts 24 of the receptacle housing 9 strongly fixed to the connector mounting surface 3*a* of the receptacle side substrate 3 by the substrate ground part 20 are adjacent to the first engagement projections 42 on the side of the direction Z1, the engagement parts 32 are prevented from pushing up the second engagement projections 43.

When the plug housing 6 of the plug connector 4 is further pulled up in the direction Z1, slipping is caused between the engagement parts 32 and the lower-side inclined surfaces 31 of the second engagement projections 43, resulting in the coupling parts 29 greatly withdrawn in the direction X1 and the direction X0. At this time, the second engagement projections 43 are never pushed up, and no torsion is caused in the side surface side deflection parts 26*b*.

When the plug housing 6 of the plug connector 4 is further pulled up in the direction Z1, the engagement parts 32 ride over the second engagement projections 43, and the operation when the connector 1 is decoupled is completed.

(Summary)

As described above, in the eighth exemplary embodiment, the displacement regulating parts 24 are formed as a part of the receptacle housing 9 of the receptacle connector 5. More specifically, when the displacement regulating parts 24 are formed as a part of the receptacle assistant fitting 11 itself, the structure of the receptacle assistant fitting 11 is inevitably made complicated. On the other hand, as described above, when the displacement regulating parts 24 are formed as a part of the receptacle housing 9, not the receptacle assistant fitting 11, the structure of the receptacle assistant fitting 11 can be made simpler. When the receptacle assistant fitting 11 is formed by folding a metal plate, the cost of manufacturing the connector 1 depends greatly on whether the structure of the receptacle assistant fitting 11 is complicated or simple. Accordingly, by forming the displacement regulating parts 24 as a part of the receptacle housing 9, the manufacturing cost of the connector 1 can be reduced.

Further, when the receptacle housing 9 is made of resin formed by metal molding as in the eighth exemplary embodiment, forming the displacement regulating parts 24 in the receptacle housing 9 itself can be achieved with lower cost in total compared with a case in which the receptacle assistant fitting 11 is folded. In this case as well, the manufacturing cost of the connector 1 can be reduced by forming the displacement regulating parts 24 as a part of the receptacle housing 9.

Further, as shown in FIG. 1B, in the first exemplary embodiment, the height of the connector 1 (the height of the connector 1 with reference to the connector mounting surface 3*a* of the receptacle side substrate 3) is dominated by the receptacle assistant fitting 11. In other words, the height of the connector 1 is dominated by the complexity of the structure of the receptacle assistant fitting 11. In summary, since the displacement regulating parts 24 are formed in the receptacle assistant fitting 11 itself in the first exemplary embodiment, the structure of the receptacle assistant fitting 11 is complicated, and further reduction in height is difficult. On the other hand, in the eighth exemplary embodiment, the displacement regulating parts 24 are not formed in the receptacle assistant fitting 11 but formed as a part of the receptacle housing 9, which makes the structure of the receptacle assistant fitting 11 simpler in structure. Since the receptacle assistant fitting 11 is made simple in structure, the height of the connector 1 can be suppressed, thereby achieving the reduction in height of the connector 1.

Furthermore, as shown in FIG. 3A for example, in the first exemplary embodiment, in order to efficiently regulate the displacement of the displacement regulating parts 24 itself, the substrate ground parts 20 of the receptacle assistant fitting 11 are formed near the displacement regulating parts 24. Meanwhile, in the eighth exemplary embodiment, the displacement regulating parts 24 are formed as a part of the receptacle housing 9, and thus there is no need to form the substrate ground part 20 near the displacement regulating parts 24. In view of this, forming the displacement regulating parts 24 as a part of the receptacle housing 9 provides higher degree of freedom in designing regarding the position where the substrate ground part 20 is formed in comparison to the case in which the displacement regulating parts 24 are formed as a part of the receptacle assistant fitting 11.

Ninth Exemplary Embodiment

Figure 30:
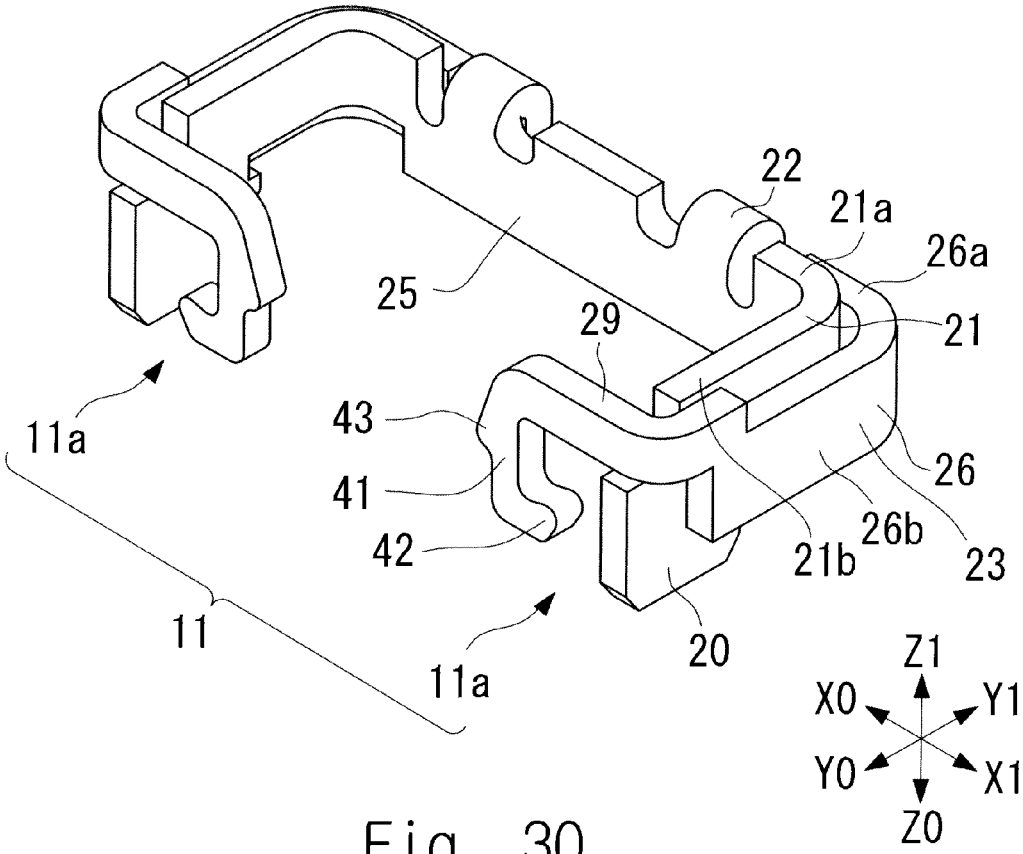
FIG. 30 is a perspective view of the receptacle assistant fitting according to the ninth exemplary embodiment seen from a coupling side.
Figure 31:
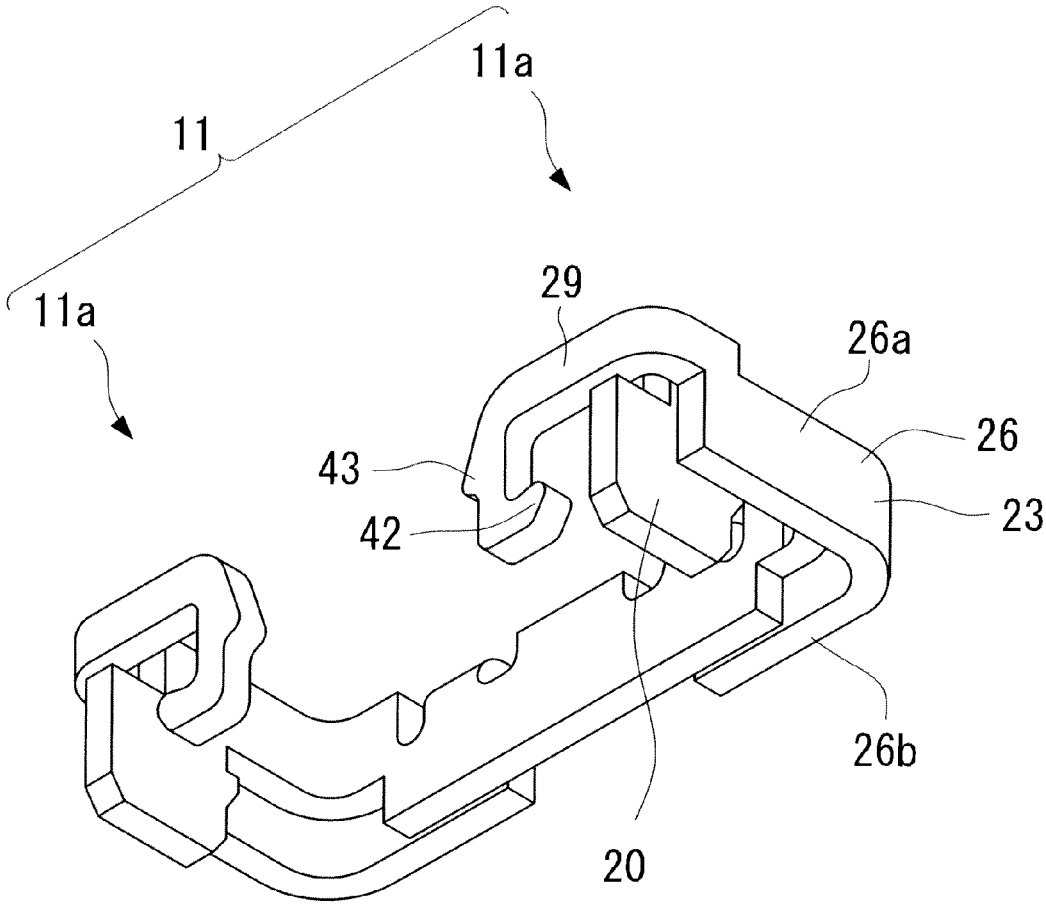
FIG. 31 is a perspective view of the receptacle assistant fitting seen from a substrate side.
Figure 31:
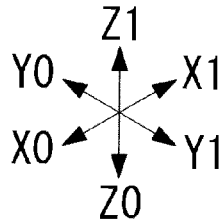
Figure 32:
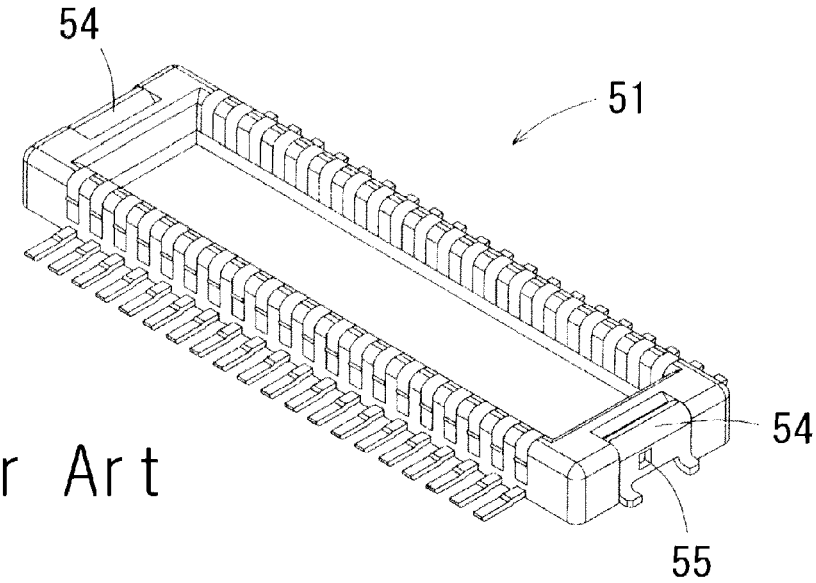
FIG. 32 is a diagram corresponding to FIG. 3 of patent document 1.
Figure 32:
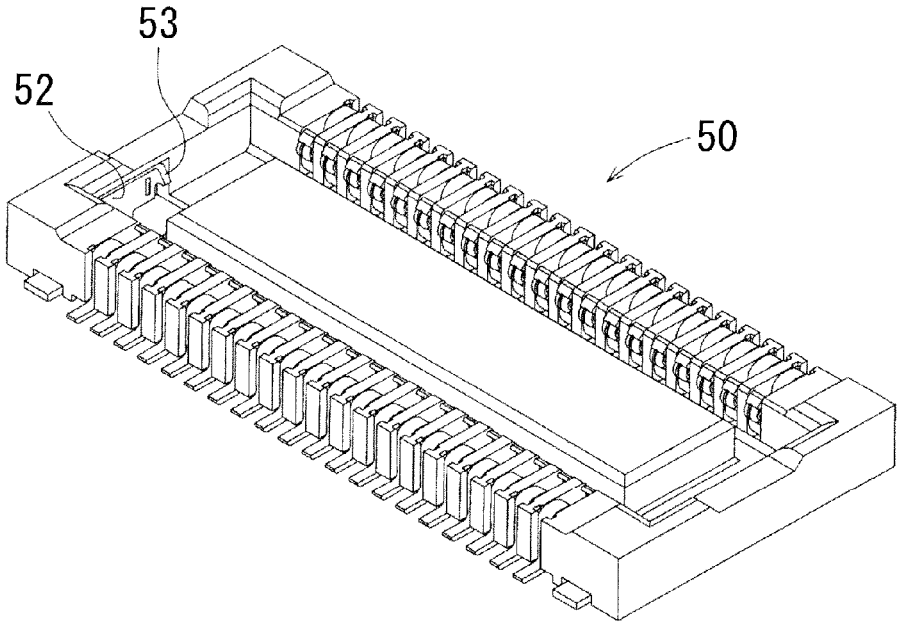
Figure 33:
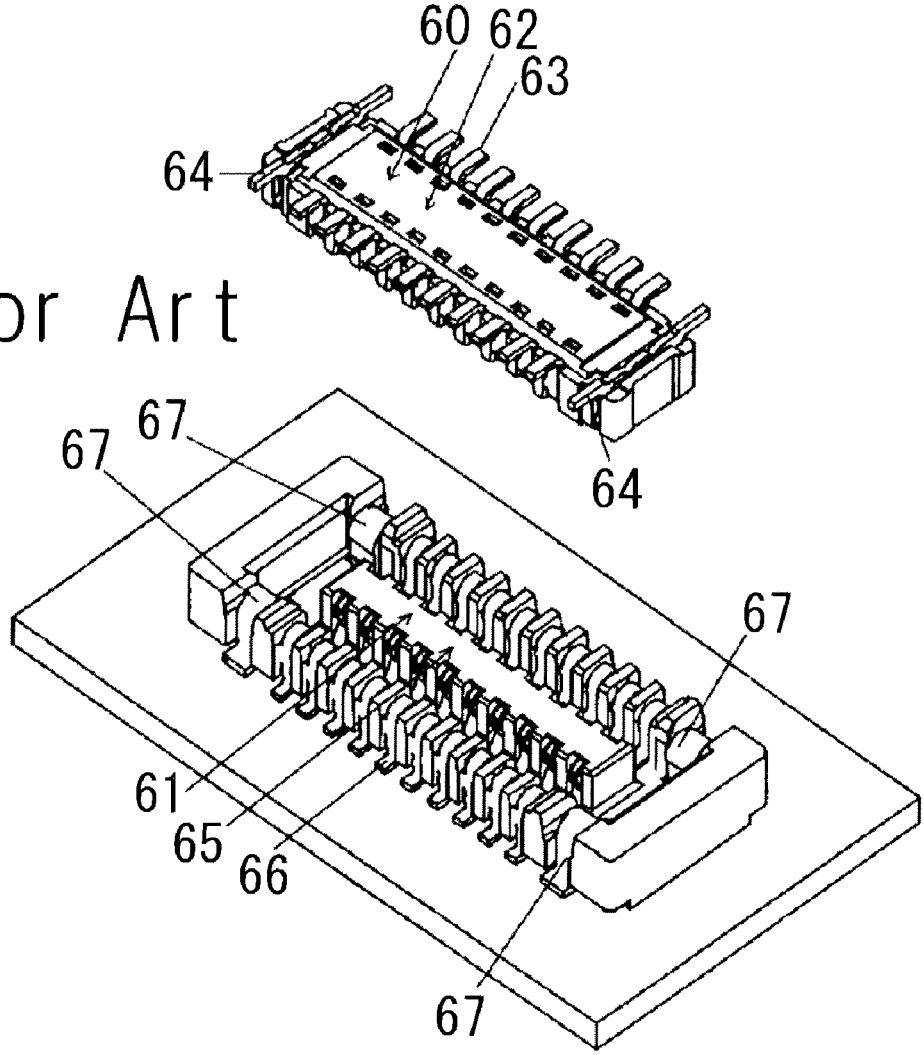
Prior Art Fig. 33
FIG. 33 is a diagram corresponding to FIG. 2 of patent document 2.
Figure 34:
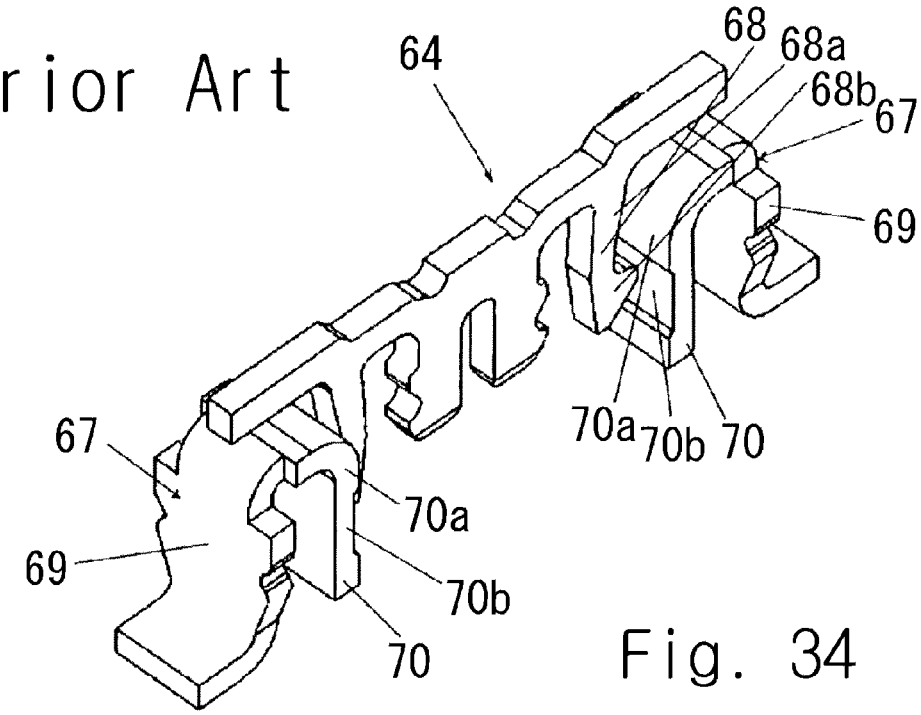
FIG. 34 is a diagram corresponding to FIG. 9 of the patent document 2.

A ninth exemplary embodiment of the present invention will be described with reference to FIGS. 30 and 31. In the ninth exemplary embodiment, differences from the eighth exemplary embodiment will be mainly described, and the overlapping description will be omitted as appropriate. Further, the components corresponding to those of the eighth exemplary embodiment are denoted by the same reference symbols.

In the eighth exemplary embodiment, as shown in FIG. 25, the substrate ground part 20 is formed in the opposite side from the contact holding projected part 9*d* of the receptacle housing 9 with the receptacle assistant fitting holding wall 9*b* of the receptacle housing 9 interposed therebetween (see also FIG. 1B). On the other hand, in the ninth exemplary embodiment, the substrate ground parts 20 are provided near the coupling parts 29 of the lock beams 23.

More specifically, the receptacle assistant fitting part 11*a* mainly includes the substrate ground part 20, the lock beam support part 21, the lock beam coupling part 22, the lock beam 23, and the stabilizer 25.

The lock beam support part 21 extends inside the deflection part 26 to be substantially parallel with the rear surface side deflection part 26*a* and the side surface side deflection part 26*b* of the lock beam 23. One end of the lock beam support part 21 is connected to the deflection part 26 through the lock beam coupling part 22, and the other end of the lock beam support part 21 is connected to the substrate ground part 20.

As described above, the position in which the substrate ground part 20 is provided can be arbitrarily determined unless the substrate ground part 20 does not inhibit the deformation of the lock beam 23 of the receptacle assistant fitting 11.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An electrical connector comprising:

a first connector part having a first housing and a first contact supported by the first housing, the first connector part being mounted on a first substrate; and a second connector part having a second housing that is capable of accommodating the first housing and a second contact supported by the second housing, the second connector part being mounted on a second substrate; wherein the first contact and the second contact are contacted with each other by coupling the first connector part and the second connector part so as to accommodate the first housing in the second housing, the first connector part and the second connector part are provided with a first assistant fitting and a second assistant fitting, respectively, to ensure coupling strength of the first connector part and the second connector part, the second assistant fitting of the second connector part includes a cantilevered lock beam having a deflection part extending in a direction substantially parallel to a connector mounting surface of the second substrate and in the outside of the second housing, and the first assistant fitting of the first connector part includes an engagement part that pushes aside the free end of the lock beam and rides over the free end of the lock beam so as to be engaged with the free end of the lock beam when the first connector part is coupled to the second connector part.

2. The electrical connector according to claim 1, wherein the deflection part of the lock beam extends along with an outer peripheral surface of the second housing, and the free end of the lock beam projects inside the second housing.

3. The electrical connector according to claim 2, wherein the free end of the lock beam has an inclined surface formed therein that allows the engagement part of the first assistant fitting to easily push aside the free end of the lock beam.

4. The electrical connector according to claim 2, further comprising a displacement regulating part that regulates displacement of the free end of the lock beam in a direction in which the first housing is removed from the second housing.

5. The electrical connector according to claim 4, wherein the displacement regulating part is formed as a part of the second housing.

6. The electrical connector according to claim 4, wherein the displacement regulating part is formed as a part of the second assistant fitting.

7. The electrical connector according to claim 6, wherein the second assistant fitting further includes a substrate ground part that regulates the displacement of the displacement regulating part itself by fixing the substrate ground part to the connector mounting surface of the second substrate.

8. The electrical connector according to claim 7, wherein the substrate ground part of the second assistant fitting is formed near the displacement regulating part.

9. The electrical connector according to claim 8, wherein the lock beam is supported by the substrate ground part, and the second assistant fitting further includes:

a lock beam support part that is connected to the substrate ground part, and extends along the lock beam from the substrate ground part toward the fixed end of the lock beam; and a lock beam coupling part that couples the lock beam support part to the fixed end of the lock beam.

10. The electrical connector according to claim 2, comprising an unlocking mechanism that withdraws the free end of the lock beam projecting inside the second housing in a direction opposite to the projecting direction.

11. The electrical connector according to claim 10, wherein the unlocking mechanism includes a torque generation means that generates torque for the lock beam to withdraw the free end of the lock beam projecting inside the second housing in the direction opposite to the projection direction.

12. The electrical connector according to claim 11, wherein the torque generation means includes a cantilevered torque generation beam that connects to a longitudinal direction middle part of the lock beam and extends in a direction substantially parallel to the connector mounting surface of the second substrate.

13. The electrical connector according to claim 12, wherein the free end of the torque generation beam is formed outside the second housing.

* * * * *